US012663192B2

(12) United States Patent
Blumhardt et al.

(10) Patent No.: US 12,663,192 B2
(45) Date of Patent: Jun. 23, 2026

(54) COMPRESSOR/EXPANDER MACHINE

(71) Applicant: BITZER Kuehlmaschinenbau GmbH, Sindelfingen (DE)

(72) Inventors: Marcus Blumhardt, Rutesheim (DE); Juergen Nill, Moessingen (DE)

(73) Assignee: BITZER Kuehlmaschinenbau GmbH, Sindelfingen (DE)

( * ) Notice: Subject to any disclaimer, the term of this patent is extended or adjusted under 35 U.S.C. 154(b) by 150 days.

(21) Appl. No.: 18/788,397

(22) Filed: Jul. 30, 2024

(65) Prior Publication Data

US 2025/0044007 A1 Feb. 6, 2025

(30) Foreign Application Priority Data

Aug. 1, 2023 (DE) ..... 10 2023 120 370.3

(51) Int. Cl.
*F25B 49/02* (2006.01)
*F04C 18/16* (2006.01)
(Continued)

(52) U.S. Cl.
CPC ..... *F25B 49/022* (2013.01); *F04C 18/16* (2013.01); *F04C 28/08* (2013.01); *F04C 28/28* (2013.01);
(Continued)

(58) Field of Classification Search
CPC ..... F25B 49/022; F25B 2600/0253; F04C 18/16; F04C 28/08; F04C 28/28; F04C 2240/40; F04C 2270/051; F04C 18/52; F04C 2240/403; F04C 28/06; F01C 1/16; F01C 13/00; F01C 20/08; F01C 23/02; F01C 20/28
See application file for complete search history.

(56) References Cited

U.S. PATENT DOCUMENTS 10,533,556 B2 * 1/2020 Johnson ..... F04C 29/124
2006/0022510 A1 2/2006 Sansone et al.
(Continued)

FOREIGN PATENT DOCUMENTS

CN 102822528 A * 12/2012 ..... F04C 18/16
CN 103270306 A * 8/2013 ..... F04C 18/00
(Continued)

*Primary Examiner* — Kun Kai Ma
(74) *Attorney, Agent, or Firm* — Reinhart Boerner Van Deuren P.C.

(57) ABSTRACT

In order to improve a method for operating a compressor/expander machine in a circuit for a working medium, wherein the compressor/expander machine has a machine housing with a screw rotor housing, in which at least one screw rotor arranged between a low-pressure side and a high-pressure side is arranged for compressing/expanding the working medium and is coupled to a motor/generator unit, in such a way that damage is avoided in the region of the screw rotors, it is proposed that an operation control unit is provided for operating the compressor/expander machine and, in the event of termination of operation of the compressor/expander machine, operates the motor/generator unit in accordance with a predetermined speed curve until a lowest speed range of the at least one screw rotor is reached, which prevents damage in the region of the screw rotor.

22 Claims, 12 Drawing Sheets

(51) Int. Cl.
*F04C 28/08* (2006.01)
*F04C 28/28* (2006.01)

(52) U.S. Cl.
CPC .... *F04C 2240/40* (2013.01); *F04C 2270/051* (2013.01); *F25B 2600/0253* (2013.01)

(56) References Cited

U.S. PATENT DOCUMENTS

| | | | | |
|---|---|---|---|---|
| 2006/0222510 | A1 | 10/2006 | Lifson et al. | |
| 2008/0063536 | A1 | 3/2008 | Koshizaka et al. | |
| 2011/0027061 | A1 | 2/2011 | Noack | |
| 2018/0340477 | A1 | 11/2018 | Uriona et al. | |
| 2019/0072301 | A1 | 3/2019 | Beckmann et al. | |
| 2021/0309112 | A1* | 10/2021 | Murthy | H02P 3/16 |
| 2021/0363919 | A1* | 11/2021 | Repentin | G01P 3/48 |
| 2021/0363989 | A1* | 11/2021 | Repentin | F01C 1/16 |
| 2025/0044007 | A1* | 2/2025 | Blumhardt | F04C 28/08 |

FOREIGN PATENT DOCUMENTS

| | | | | | |
|---|---|---|---|---|---|
| CN | 118911985 | A | * | 11/2024 | F25B 41/30 |
| DE | 102016109907 | A1 | | 11/2017 | |
| DE | 102019102819 | A1 | | 8/2020 | |
| DE | 102019219997 | A1 | | 6/2021 | |
| DE | 102020130541 | B3 | | 1/2022 | |
| EP | 1654443 | B1 | | 3/2007 | |
| EP | 1835613 | A2 | * | 9/2007 | H02P 21/0021 |
| JP | S63210619 | A | * | 9/1988 | |
| JP | 3569924 | B2 | * | 9/2004 | F04C 29/0085 |
| JP | 2004340410 | A | * | 12/2004 | |
| JP | 3639396 | B2 | * | 4/2005 | |
| JP | 2008196442 | A | * | 8/2008 | |
| JP | 2017212794 | A | * | 11/2017 | |
| WO | WO-2005038257 | A1 | * | 4/2005 | F04C 28/08 |
| WO | WO 2017/076588 | A1 | | 5/2017 | |
| WO | WO 2017/137317 | A1 | | 8/2017 | |
| WO | WO 2017/190917 | A1 | | 11/2017 | |
| WO | WO-2020213241 | A1 | * | 10/2020 | F04C 28/08 |

* cited by examiner

COMPRESSOR/EXPANDER MACHINE

The present disclosure relates to the subject matter disclosed in German application number 10 2023 120 370.3 of 1 Aug. 2023, which is incorporated herein by reference in its entirety and for all purposes.

BACKGROUND OF THE INVENTION

The invention relates to a method for operating a compressor/expander machine in a circuit for a working medium, wherein the compressor/expander machine has a machine housing with a screw rotor housing, in which at least one screw rotor arranged between a low-pressure side and a high-pressure side is arranged for compressing/expanding the working medium and is coupled to a motor/generator unit.

The problem with such a method is that when the compressor/expander machine is shut down, damage occurs in the region of the at least one screw rotor, in particular in the region of the high-pressure-side end faces of the at least one screw rotor and the end wall surfaces of the machine housing opposite these end faces, and has a wide variety of causes, for example the pressure difference between the high-pressure side and the low-pressure side and possibly a reversal of the direction of rotation of the screw rotors or an interruption of the lubrication in the region of the at least one screw rotor.

In accordance with an embodiment of the invention, a method of the type described at the outset is improved in such a way that damage in the region of the at least one screw rotor is avoided.

SUMMARY OF THE INVENTION

In accordance with an embodiment of the invention, provision is made in a method of the type described at the outset that an operation control unit is provided for operating the compressor/expander machine which, in the event of the compressor/expander machine ceasing to operate, reduces the speed of the motor/generator unit in accordance with a predetermined speed curve until a lowest speed range of the at least one screw rotor is reached which prevents damage in the region of the at least one screw rotor.

The advantage of this solution is that the predetermined speed curve enables a defined reduction in the speed of the screw rotor down to a lowest speed range of the at least one screw rotor, thus avoiding the problems mentioned above.

It is particularly advantageous if the speed curve of the motor/generator unit is specified by a successive sequence of speed data, which can also have successive speed steps, for example.

This successive sequence of speed data can also provide for a variation of the speed over time.

However, it is particularly favorable if the successive speed data have successive speed values that are constantly decreasing.

The speed values could still be staggered over time.

However, a particularly favorable solution is that the speed values form a braking ramp over time, i.e., that there is a continuous sequence of constantly decreasing speed values that form the braking ramp over time.

It is particularly favorable if the speed values of the braking ramp decrease according to at least one gradient over time.

It is preferable here for the braking ramp to have a braking start ramp for which the speed values decrease over time according to a first gradient.

It is even better if, following the braking start ramp, the braking ramp has an end braking ramp in which the speed values decrease over time according to a second gradient in order to initially achieve a strong reduction in the speed of the screw rotors with the first gradient and to achieve the smoothest possible transition to the lowest speed range of the at least one screw rotor with the subsequent second gradient of the end braking ramp.

To ensure that the at least one screw rotor does not accelerate again, it is preferable for the operation control unit to continue operating the motor/generator unit in the lowest speed range of the at least one screw rotor after the braking ramp.

Preferably, the lowest speed range results in such a low speed of the at least one screw rotor that no abrasion, heating or overheating occurs in the region of the sealing gap between the high-pressure-side end faces of the screw rotor and the end wall surfaces.

Preferably, the lowest speed range of the at least one screw rotor is in the range of a speed of the at least one screw rotor that extends from 20 Hz to 0 Hz.

Preferably, the lowest speed range of the at least one screw rotor extends from a speed of 5 Hz to 0 Hz; it is even better if the lowest speed range of the at least one of the screw rotors extends from a speed of 3 Hz to 0 Hz; in extreme cases, the speed is 0 Hz.

In principle, the operation control unit could be operated in such a way that it permanently maintains the lowest speed range of the at least one screw rotor until the compressor/expander machine is next started.

For reasons of efficiency, however, it is advantageous if the operation control unit maintains the lowest speed range of the at least one screw rotor during a predetermined holding time, so that the period of action on the at least one screw rotor can be limited.

Preferably, the holding time should be at least three seconds.

It is even better if the holding time is at least five seconds.

It is expedient that the holding time is maintained for so long that it can be assumed that in the compressor/expander machine there are no longer any pressure differences between the low-pressure side and the high-pressure side acting on the at least one screw rotor.

It is expedient here for the holding time to be a maximum of three minutes.

It is even better if the holding time is at most one minute.

Alternatively, it is advantageous if the operation control unit maintains the lowest speed range of the at least one screw rotor until there are no longer any pressure differences between the low-pressure side and the high-pressure side in the compressor/expander machine that have an accelerating effect on the screw rotors.

For this purpose, it is expedient to detect the pressure differences using sensors.

An advantageous solution is for the operation control unit, during normal operation, to operate the compressor/expander machine in a normal operating mode in which the speed of the screw rotor is controlled by a higher-level control system of the circuit.

In order to ensure that, in the presence of signals requiring termination of operation of the compressor/expander unit, the operation control unit carries out termination of operation of the compressor/expander unit in accordance with the solution according to the invention, it is provided that the operation control unit is monitored in normal operating mode by a monitoring mode which detects signals requiring termination of operation of the compressor/expander unit in normal operating mode, and that the operation control unit transitions to an operation termination mode in the presence of such a signal.

In such a case, it is preferable for the motor/generator unit to be operated according to the predetermined speed curve to terminate operation of the compressor/expander machine in operation termination mode.

In order to also recognize the extent to which the lowest speed range of the at least one screw rotor has been reached in the operation termination mode, the operation termination mode is monitored by a speed monitoring mode, which detects when the lowest speed range of the at least one screw rotor has been reached.

In particular, the speed monitoring mode provides for the speed monitoring mode, when the lowest speed range is reached, to initiate a transition to a holding mode in which the speed of the at least one screw rotor is maintained in the lowest speed range for a defined holding time, which ensures that there are no pressure differences acting in an accelerating manner on the at least one screw rotor at the end of the holding time, so that there is also no effect on the at least one screw rotor that could lead to damage in the region of the at least one screw rotor.

Alternatively, it is provided that the speed monitoring mode, when the lowest speed range is reached, initiates a transition to a holding mode in which the speed of the at least one screw rotor is maintained in the lowest speed range until there are no pressure differences that have an accelerating effect on the at least one screw rotor, so that there is also no effect on the at least one screw rotor that could lead to damage in the region of the at least one screw rotor.

Furthermore, it is preferable for the operation control unit to activate a pressure relief between the low-pressure side and the high-pressure side of the compressor/expander machine during the operation termination mode and/or during the holding mode, in order to ensure that there are no effects, in particular significant pressure differences, on the at least one screw rotor at least at the end of the holding mode.

In particular it is provided that the compressor/expander machine described above has two intermeshing screw rotors in the screw rotor housing.

Furthermore, a particularly advantageous embodiment provides for the compressor/expander machine and the motor/generator unit to be arranged in an overall housing.

A compressor machine according to the invention is arranged, for example, in a cooling circuit or a heat pump circuit or a vapor compression system.

In the special case that the compressor/expander machine operates as a compressor machine, it is provided that the operation control unit is configured as a compressor operation control unit and comprises an inverter device which has a rectifier which feeds a DC link from an AC supply grid, and that the inverter device has a converter which feeds the motor unit of the compressor machine from the DC link.

Furthermore, it is preferably provided for the compressor operation control unit to have a control unit that controls the inverter device, wherein the control unit can also be integrated into the inverter device, for example.

In principle, the control unit could control both the converter and the rectifier. For reasons of simplicity, it is particularly advantageous if the control unit for controlling the speed of the motor unit controls the converter of the inverter device, in particular only the converter of the inverter device, as this simplified solution does not provide for any feedback effect of the rectifier on the supply grid.

In particular, the control unit is configured so that it, by controlling the converter, controls the speed of the motor unit during operation of the compressor machine in a normal operating mode in accordance with a signal that is generated by a higher-level control system for operation of the circuit.

It is particularly expedient here if the control unit with a monitoring mode constantly checks the normal operating mode to ascertain whether the normal operating mode should be maintained or terminated in order to ensure that the normal operating mode is not continued without authorization.

In particular, it is provided here that the control unit activates an operation termination mode in the monitoring mode when a shutdown signal transmitted to the control unit is present, thereby initiating a transition from the normal operating mode to the operation termination mode.

Preferably, the control unit in the operation termination mode operates the compressor machine according to a predetermined speed curve until the lowest speed range of the at least one screw rotor is reached, which prevents damage in the region of the at least one of the screw rotors.

Furthermore, it is preferably provided for the control unit to monitor the operation termination mode with a speed monitoring mode in order to detect whether the lowest speed range of the at least one screw rotor has been reached.

Furthermore, it is preferably provided for the control unit, when the lowest speed range preventing damage in the region of the at least one screw rotor is reached, to transition to a holding mode in which the lowest speed range of the at least one screw rotor is maintained.

An expander machine according to the invention is arranged, for example, in a thermodynamic cycle, in particular an ORC system or a vapor expansion system.

Therefore, a further advantageous solution is that the compressor/expander machine operates as an expander machine, that the operation control unit is configured as an expander operation control unit and comprises an inverter device, which has a grid converter, which in turn is connected to an AC supply grid, and feeds energy from the AC supply grid into a DC link or feeds energy from the DC link into the AC supply grid, that the expander operation control unit has a compressor converter, which feeds a motor for a compressor for a circuit operated in a thermodynamic cycle from the DC link, and that the expander operation control unit has a generator converter, which feeds energy supplied by the generator unit into the DC link.

The expander machine can be advantageously controlled in the various operating states with such a specially configured inverter device.

In particular, it is also provided that the generator converter specifies a start-up behavior of the generator unit through the coupling to the DC link, in particular briefly energizing the generator unit during start-up.

Furthermore, it is preferable for the expander operation control unit to have a control unit that controls the inverter device.

Such a control unit is preferably configured in such a way that it controls the generator converter in order to feed the electrical power generated by the generator into the DC link or, if necessary, to specify the start-up behavior of the generator unit by way of the coupling to the DC link.

In addition, it is also advantageously provided that the control unit controls the grid converter in order to be able to feed power from the grid into the DC link on the one hand and to feed the electrical power of the generator unit fed into the DC link by the generator converter into the grid on the other hand.

Furthermore, it is preferably provided that the control unit controls the compressor converter in order to control the high pressure in the thermodynamic cycle by controlling the power of the compressor.

A particularly expedient solution provides for the control unit, by controlling the grid converter, the compressor converter and the generator converter, to control the speed of the motor for the compressor and the generator unit in normal operating mode in accordance with a signal for reaching and maintaining the high pressure at the high-pressure connection of the expander machine, and to feed the electrical power generated by the generator unit to the DC link, wherein the grid converter feeds the excess electrical power from the DC link to the supply grid.

In addition, it is preferably provided that the control unit monitors the normal operating mode in a monitoring mode to determine whether a possible shutdown signal is present and, if such a signal is present, initiates a transition from the normal operating mode to the operation termination mode, in which the generator unit contributes according to a predetermined speed curve until the lowest speed range of the at least one of the screw rotors, which prevents damage in the region of the at least one screw rotor, is reached.

Furthermore, it is expediently provided for the control unit to monitor the operation termination mode with a speed monitoring mode in order to determine whether the lowest speed range of the at least one screw rotor has been reached.

In addition, it is preferably provided for the control unit, when the lowest speed range of the at least one screw rotor is reached, to transition to a holding mode in which the speed of the at least one screw rotor is maintained in the lowest speed range by control of the generator converter.

Another expedient solution is for the control unit, after the end of the holding mode, to transition to a waiting mode in which presets are made for a re-start of the generator unit by the generator converter, wherein the waiting mode is monitored by a waiting monitoring mode, which initiates a transition to a start-up mode in the event of a signal for a re-start.

It is preferably provided that the control unit controls the generator converter in the start-up mode in such a way that it briefly energizes the generator unit, in particular for pre-magnetization, for a defined start-up.

For the method according to the invention, in which damage in the region of the at least one screw rotor is to be avoided with the most comprehensive measures possible, it is also advantageous if a lubricant support film is built up between the high-pressure-side end faces of the screw rotor and the end wall surface of the machine housing by means of a lubricant supply unit.

It is particularly advantageous here if the lubricant support film is maintained by supplying lubricant to a support region that extends between the high-pressure-side end face of the screw rotor and the end wall surface and between the innermost diameter of the high-pressure-side end face and a radially outer circular boundary line.

No defined information has been provided regarding the position of the circular boundary line.

One advantageous solution is that the circular boundary line runs in particular at a radial spacing from the screw rotor axis, which corresponds at most to the radial spacing of the innermost root of a particular screw rotor contour from the corresponding screw rotor axis.

In addition, the invention also relates to a compressor/expander machine for operation in a circuit for a working medium, or a compressor machine or an expander machine according to the features described above.

The above description of solutions according to the invention thus comprises in particular the various combinations of features defined by the following consecutively numbered embodiments:

1. A method for operating a compressor/expander machine in a circuit (300, 400) for a working medium, wherein the compressor/expander machine (10) has a machine housing (11) with a screw rotor housing (12), in which at least one screw rotor (36, 38) arranged between a low-pressure side (62) and a high-pressure side (64) is arranged for compressing/expanding the working medium and is coupled to a motor/generator unit (132), wherein, for operating the compressor/expander machine (10*a, b*), an operation control unit (340, 440) is provided, which, in the event of termination of operation of the compressor/expander machine (10*a, b*), operates the speed (D) of the motor/generator unit (132*a, b*) in accordance with a predetermined speed curve until a lowest speed range (NDB) of the at least one of the screw rotors (36, 38) is reached, which prevents damage in the region of the screw rotors (36, 38).
2. A method in accordance with embodiment 1, wherein the speed curve of the motor/generator unit is predetermined by a successive sequence of speed data.
3. A method in accordance with embodiment 2, wherein the successive speed data have successive speed values that are constantly decreasing.
4. A method in accordance with embodiment 3, wherein the speed values form a braking ramp (BR) over time.
5. A method in accordance with embodiment 4, wherein the speed values of the braking ramp (BR) decrease according to at least one gradient (Δ1, Δ2) over time.
6. A method in accordance with embodiment 4 or 5, wherein the braking ramp (BR) has a braking start ramp (BSR) for which the speed values decrease over time according to a first gradient (Δ1).
7. A method in accordance with embodiment 5 or 6, wherein the braking ramp (BR) has, adjoining the braking start ramp (BSR), an end braking ramp (EBR) for which the speed values decrease over time according to a second gradient (Δ2).
8. A method in accordance with the preceding embodiments, wherein the operation control unit (340, 440) continues to operate the motor generator unit (132*a, b*) in the lowest speed range (NDB) of the at least one screw rotor (36, 38) following the braking ramp (BR).
9. A method in accordance with embodiment 8, wherein the lowest speed range (NDB) results in such a low speed of the at least one of the screw rotors (36, 38) that no abrasion, heating or overheating occurs in the region of the sealing gap (130) between the high-pressure-side end face (122, 124) of the at least one of the screw rotors (36, 38) and the respective end wall surface (126, 128).
10. A method in accordance with the preceding embodiments, wherein the lowest speed range (NDB) extends from a speed of the at least one of the screw rotors (36, 38) from 20 Hz to 0 Hz.
11. A method in accordance with the preceding embodiments, wherein the operation control unit (340, 440)

maintains the lowest speed range (NDB) of the at least one screw rotor (36, 38) during a predetermined holding time (HT).

12. A method in accordance with embodiment 11, wherein the holding time (HT) is at least 3 seconds.
13. A method in accordance with embodiment 11 or 12, wherein the holding time (HT) is at least 5 seconds.
14. A method in accordance with embodiments 11 to 13, wherein the holding time (HT) is maintained for so long that it can be assumed that in the compressor/expander machine (10*a, b*) there are no longer any pressure differences between the low-pressure side (62) and the high-pressure side (64) acting on the screw rotors (36, 38).
15. A method in accordance with embodiments 11 to 14, wherein the holding time (HT) is a maximum of three minutes.
16. A method in accordance with the preceding embodiments, wherein the operation control unit (340, 440) maintains the lowest speed range (NDB) of the at least one screw rotor (36, 38) until there are no longer any pressure differences between the low-pressure side (62) and the high-pressure side (64) in the compressor/expander machine (10*a, b*) that have an accelerating effect on the screw rotors (36, 38).
17. A method in accordance with the preceding embodiments, wherein the operation control unit (340, 440) operates in a normal operating mode (382, 502) during normal operation of the compressor/expander machine (10*a, b*).
18. A method in accordance with embodiment 17, wherein the operation control unit (340, 440) is monitored in the normal operating mode (382, 502) by a monitoring mode (384, 504) which detects signals which require termination of operation of the compressor/expander unit (10*a, b*), and wherein the operation control unit (340, 440) transitions to an operation termination mode (386, 506) if such a signal is present.
19. A method in accordance with embodiment 18, wherein in the operation termination mode (386, 506) the motor/generator unit (132*a, b*) is operated according to the predetermined speed profile to terminate operation of the compressor/expander machine (10*a, b*).
20. A method in accordance with embodiment 18 or 19, wherein the operation termination mode (386, 506) is monitored by a speed monitoring mode (388, 508), which detects when the lowest speed range (NDB) of the at least one screw rotor (36, 38) has been reached.
21. A method in accordance with embodiment 20, wherein the speed monitoring mode (388, 508), when the lowest speed range (NDB) is reached, initiates a transition to a holding mode (390, 510) in which the speed of the at least one screw rotor (36, 38) is maintained in the lowest speed range (NDB) over a defined holding time (HT), which ensures that no pressure differences acting in an accelerating manner on the at least one screw rotor (36, 38) are present at the end of the holding time.
22. A method in accordance with embodiment 20, wherein the speed monitoring mode (388, 508), when the lowest speed range (NDB) is reached, initiates a transition to a holding mode (390, 510) in which the speed of the at least one screw rotor (36, 38) is maintained in the lowest speed range (NDB) until no pressure differences acting in an accelerating manner on the at least one screw rotor (36, 38) are present.
23. A method in accordance with embodiments 19 to 22, wherein the operation control unit (340, 440), during the operation termination mode (386, 506) and/or during the holding mode (390, 510), activates a pressure relief (350, 450) between the low-pressure side (62) and the high-pressure side (64) of the compressor/expander machine.
24. A method in accordance with the preceding embodiments, wherein the compressor/expander machine (10) operates as a compressor machine (10*a*), wherein the operation control unit (340, 440) is configured as a compressor operation control unit (340) and comprises an inverter device (360) which has a rectifier (362) which feeds a DC link (364) from an AC supply grid (344), and wherein the inverter device (360) has a converter (368) which feeds the motor unit (132*a*) of the compressor machine (10*a*) from the DC link (364).
25. A method in accordance with embodiment 24, wherein the compressor operation control unit (340) has a control unit (372) controlling the inverter device (360).
26. A method in accordance with embodiment 25, wherein the control unit (372) controls the converter (368) of the inverter device (360) to control the speed of the motor unit (132*a*).
27. A method in accordance with embodiment 25 or 26, wherein the control unit (372), by controlling the converter (368), controls the speed of the motor unit (132*a*) during operation of the compressor machine (10*a*) in a normal operating mode (382) in accordance with a signal (374) that is generated by a higher-level controller.
28. A method in accordance with embodiments 25 to 27, wherein the control unit (372) with a monitoring mode (384) constantly checks the normal operating mode (382) to ascertain whether the normal operating mode (382) should be maintained or terminated.
29. A method in accordance with embodiment 28, wherein the control unit (372) controls an operation termination mode (386) in the monitoring mode (384) when a shutdown signal (376) transmitted to the control unit (372) is present, thereby initiating a transition from the normal operating mode (382) to the operation termination mode (386).
30. A method in accordance with embodiment 29, wherein the control unit (372) in the operation termination mode (386) operates the compressor machine (10*a*) according to a predetermined speed curve until there is reached the lowest speed range (NDB) of the at least one screw rotor, which prevents damage in the region of the at least one screw rotor.
31. A method in accordance with embodiment 29 or 30, wherein the control unit (372) monitors the operation termination mode (386) with a speed monitoring mode (388) until the lowest speed range (NDB) of the at least one screw rotor (36, 38) is reached.
32. A method in accordance with embodiment 31, wherein the control unit (372), when the lowest speed range (NDB) preventing damage in the region of the at least one screw rotor (36, 38) is reached, transitions to a holding mode (390) in which the lowest speed range (NDB) of the at least one screw rotor (36, 38) is maintained.
33. A method in accordance with embodiments 1 to 21, wherein the compressor/expander machine operates as an expander machine (10*b*), wherein the operation control unit is configured as an expander operation control unit (440) and has an inverter device (460) which has a grid converter (462) which, for its part, is connected to an AC supply grid (444) and feeds energy from the supply grid into a DC link (464) or feeds energy from the DC link (464) into the supply grid (444), wherein the expander operation control unit (440) has a compressor converter (468) which feeds a motor (404) for a compressor (402) for a circuit (400) operated in a thermodynamic cycle from the DC link (464), and wherein the expander operation control unit (440) has a generator converter (470) which feeds energy supplied by the generator unit (132*b*) into the DC link (464).

34. A method in accordance with embodiment 33, wherein the generator converter (470) specifies a start-up behavior of the generator unit (132*b*) through the coupling to the DC link (464), in particular briefly energizing the generator unit (132*b*) during start-up.

35. A method in accordance with embodiments 33 or 34, wherein the expander operation control unit (440) has a control unit (472) controlling the inverter device (460).

36. A method in accordance with embodiment 35, wherein the control unit (472) controls the generator converter (470).

37. A method in accordance with embodiment 35 or 36, wherein the control unit (472) controls the grid converter (462).

38. A method in accordance with embodiments 33 to 37, wherein the control unit (472) controls the compressor converter (468).

39. A method in accordance with embodiments 33 to 38, wherein the control unit (472), by controlling the grid converter (462), the compressor converter (468) and the generator converter (470), controls the motor (404) in respect of the speed of the motor (404) for the compressor (402) and the generator unit (132*b*) in the normal operating mode (502) in accordance with a signal (474) for reaching and maintaining the high pressure at the high-pressure connection (84) of the expander machine (10*b*), and feeds the electrical power generated by the generator unit (132*b*) to the DC link (464), wherein the grid converter (462) feeds the excess electrical power from the DC link (464) to the supply grid (444).

40. A method in accordance with embodiments 33 to 39, wherein the control unit (472) monitors the normal operating mode (502) in a monitoring mode (504) to determine whether a possible shutdown signal (476, 468, 492, 494 and 496) is present and, if such a signal is present, initiates a transition from the normal operating mode (502) to an operation termination mode (506), in which the generator unit (132*b*) contributes according to a predetermined speed curve until the lowest speed range (NDB) of the at least one screw rotor (36, 38) is reached, which prevents damage in the region of the at least one screw rotor (36, 38).

41. A method in accordance with embodiments 33 to 40, wherein the control unit (402) monitors the operation termination mode (506) with a speed monitoring mode (588) as to whether the lowest speed range (NDB) of the at least one screw rotor (36, 38) has been reached.

42. A method in accordance with embodiments 33 to 41, wherein the control unit (472), when the lowest speed range (NDB) of the at least one screw rotor (36, 38) is reached, transitions to a holding mode (590) in which the speed (D) of the at least one screw rotor in the lowest speed range (NDB) is maintained by control of the generator converter (470).

43. A method in accordance with embodiments 33 to 42, wherein the control unit (472), after the end of the holding mode (390), transitions to a waiting mode (512) in which presets are made for a re-start of the generator unit (132*b*) by the generator converter (470), wherein the waiting mode (512) is monitored by a waiting monitoring mode (514), which initiates a transition to a start-up mode (516) in the event of a signal for a re-start.

44. A method in accordance with embodiment 43, wherein the control unit (472) controls the generator converter (470) in the start-up mode (516).

45. A method in accordance with the preceding embodiments, wherein in at least one of the screw rotors (36, 38) a lubricant support film (210) is built up between the high-pressure-side end faces (122, 124) of the screw rotors (36, 38) and the end wall surfaces (126, 128) of the machine housing (10) by means of a lubricant supply unit (222, 224).

46. A method in accordance with embodiment 45, wherein the lubricant support film (210) is maintained by supplying lubricant to one of the support regions (232, 234) extending between the high-pressure-side end face (122, 124) of the particular screw rotor (36, 38) and the end wall surface (126, 128) and between the innermost diameter (242, 244) of the high-pressure-side end face (122, 124) and a radially outer circular boundary line (246, 248).

47. A method in accordance with embodiment 46, wherein the circular boundary line (246, 248) runs in particular at a radial spacing from the screw rotor axis (52, 54) which at most corresponds to the radial spacing of an innermost root (252, 254) of a particular screw rotor contour (42, 44) from the corresponding screw rotor axis (52, 54).

48. A method for operating a refrigerant circuit (300), in particular a cooling device or a heat pump, comprising a heat exchanger (302) in which expanded refrigerant absorbs heat, a compressor machine (10*a*) for compressing the expanded refrigerant and a heat exchanger (322) in which the compressed refrigerant emits heat, and an expansion unit (330) for expanding the compressed refrigerant, wherein the compressor machine (10*a*) is operated in accordance with embodiments 1 to 32.

49. A method for operating a thermodynamic cycle (400), in particular an ORC system or a vapor compression system, comprising a compressor (402) for compressing the working medium, a heat exchanger (412) for heating the working medium, an expander machine (10*b*) for expanding the compressed and heated working medium and a heat exchanger (424) for cooling the expanded working medium, wherein the expander machine (10*b*) is operated in accordance with preceding embodiments 1 to 23 and 33 to 47.

50. A compressor/expander machine for operation in a circuit (300, 400) for a working medium, wherein the compressor/expander machine (10) has a machine housing (11) with a screw rotor housing (12), in which at least one screw rotor (36, 38) arranged between a low-pressure side (62) and a high-pressure side (64) is arranged for compressing/expanding the working medium and is coupled to a motor/generator unit (132), wherein, for operating the compressor/expander machine (10*a*, *b*), an operation control unit (340, 440) is provided, which, in the event of termination of operation of the compressor/expander machine (10*a*,

*b*), operates the motor/generator unit (132*a, b*) in accordance with a predetermined speed curve until a lowest speed range (NDB) of the at least one of the screw rotors (36, 38) is reached, which prevents damage in the region of the screw rotors (36, 38).

51. A compressor/expander machine in accordance with embodiment 50, wherein the speed curve of the motor/generator unit is predetermined by a successive sequence of speed data.
52. A compressor/expander machine in accordance with embodiment 51, wherein the successive speed data have successive speed values that are constantly decreasing.
53. A compressor/expander machine in accordance with embodiment 52, wherein the speed values form a braking ramp (BR) over time.
54. A compressor/expander machine in accordance with embodiment 52 or 53, wherein the speed values of the braking ramp (BR) decrease according to at least one gradient (41, 42) over time.
55. A compressor/expander machine in accordance with embodiment 53 or 54, wherein the braking ramp (BR) has a braking start ramp (BSR) for which the speed values decrease over time according to a first gradient (Δ1).
56. A compressor/expander machine in accordance with embodiment 54 or 55, wherein the braking ramp (BR) has, adjoining the braking start ramp (BSR), an end braking ramp (EBR) for which the speed values decrease over time according to a second gradient (42).
57. A compressor/expander machine in accordance with embodiments 50 to 56, wherein the operation control unit (340, 440) continues to operate the motor generator unit (132*a, b*) in the lowest speed range (NDB) of the at least one screw rotor (36, 38) following the braking ramp (BR).
58. A compressor/expander machine in accordance with embodiment 57, wherein the lowest speed range (NDB) results in such a low speed of the at least one of the screw rotors (36, 38) that no abrasion, heating or overheating occurs in the region of the sealing gap (130) between the high-pressure-side end faces (122, 124) of the at least one of the screw rotors (36, 38) and the respective end wall surface (126, 128).
59. A compressor/expander machine in accordance with embodiments 50 to 58, wherein the lowest speed range (NDB) extends from a speed of the at least one of the screw rotors (36, 38) from 20 Hz to 0 Hz.
60. A compressor/expander machine in accordance with embodiments 50 to 59, wherein the operation control unit (340, 440) maintains the lowest speed range (NDB) of the at least one screw rotor (36, 38) during a predetermined holding time (HT).
61. A compressor/expander machine in accordance with embodiment 60, wherein the holding time (HT) is at least 3 seconds.
62. A compressor/expander machine in accordance with embodiment 60 or 61, wherein the holding time (HT) is at least 5 seconds.
63. A compressor/expander machine in accordance with embodiments 60 to 62, wherein the holding time (HT) is maintained for so long that it can be assumed that in the compressor/expander machine (10*a, b*) there are no longer any pressure differences between the low-pressure side (62) and the high-pressure side (64) acting on the screw rotors (36, 38).
64. A compressor/expander machine in accordance with embodiments 60 to 63, wherein the holding time (HT) is a maximum of three minutes.
65. A compressor/expander machine in accordance with embodiments 50 to 64, wherein the operation control unit (340, 440) maintains the lowest speed range (NDB) of the at least one screw rotor (36, 38) until there are no longer any pressure differences between the low-pressure side (62) and the high-pressure side (64) in the compressor/expander machine (10*a, b*) that have an accelerating effect on the screw rotors (36, 38).
66. A compressor/expander machine in accordance with preceding embodiments 50 to 65, wherein the operation control unit (340, 440) operates in a normal operating mode (382, 502) during normal operation of the compressor/expander machine (10*a, b*).
67. A compressor/expander machine in accordance with embodiment 66, wherein the operation control unit (340, 440) is monitored in the normal operating mode (382, 502) by a monitoring mode (384, 504) which detects signals which require termination of operation of the compressor/expander unit (10*a, b*), and wherein the operation control unit (340, 440) transitions to an operation termination mode (386, 506) if such a signal is present.
68. A compressor/expander machine in accordance with embodiment 67, wherein in the operation termination mode (386, 506) the motor/generator unit (132*a, b*) is operated according to the predetermined speed profile to terminate operation of the compressor/expander machine (10*a, b*).
69. A compressor/expander machine in accordance with embodiment 67 or 68, wherein the operation termination mode (386, 506) is monitored by a speed monitoring mode (388, 508), which detects when the lowest speed range (NDB) of the at least one screw rotor (36, 38) has been reached.
70. A compressor/expander machine in accordance with embodiment 69, wherein the speed monitoring mode (388, 508), when the lowest speed range (NDB) is reached, initiates a transition to a holding mode (390, 510) in which the speed of the at least one of the screw rotors (36, 38) is maintained in the lowest speed range (NDB) over a defined holding time (HT), which ensures that no pressure differences acting in an accelerating manner on the at least one screw rotor (36, 38) are present at the end of the holding time.
71. A compressor/expander machine in accordance with embodiment 70, wherein the speed monitoring mode (388, 508), when the lowest speed range (NDB) is reached, initiates a transition to a holding mode (390, 510) in which the speed of the at least one screw rotor (36, 38) is maintained in the lowest speed range (NDB) until no pressure differences acting in an accelerating manner on the at least one screw rotor (36, 38) are present.
72. A compressor/expander machine in accordance with embodiments 68 to 71, wherein the operation control unit (340, 440) during the operation termination mode (386, 506) and/or during the holding mode (390, 510) activates a pressure relief (350, 450) between the low-pressure side (62) and the high-pressure side (64) of the compressor/expander machine.
73. A compressor machine in accordance with embodiments 50 to 72, wherein the operation control unit (340, 440) is configured as a compressor operation control unit (340) and comprises an inverter device (360)

which has a rectifier (362) which feeds a DC link (364) from an AC supply grid (344), and wherein the inverter device (360) has a converter (368) which feeds the motor unit (132*a*) of the compressor machine (10*a*) from the DC link (364).

74. A compressor machine in accordance with embodiment 73, wherein the compressor operation control unit (340) has a control unit (372) controlling the inverter device (360).

75. A compressor machine in accordance with embodiment 74, wherein the control unit (372) controls the converter (368) of the inverter device (360) to control the speed of the motor unit (132*a*).

76. A compressor machine in accordance with embodiment 74 or 75, wherein the control unit (372), by controlling the converter (368), controls the speed of the motor unit (132*a*) during operation of the compressor machine (10*a*) in a normal operating mode (382) in accordance with a signal (374) that is generated by a higher-level controller.

77. A compressor machine in accordance with embodiments 74 to 76, wherein the control unit (372) with a monitoring mode (384) constantly checks the normal operating mode (382) to ascertain whether the normal operating mode (382) should be maintained or terminated.

78. A compressor machine in accordance with embodiment 77, wherein the control unit (372) activates an operation termination mode (386) in the monitoring mode (384) when a shutdown signal (376) transmitted to the control unit (372) is present, thereby initiating a transition from the normal operating mode (382) to the operation termination mode (386).

79. A compressor machine in accordance with embodiment 78, wherein the control unit (372) in the operation termination mode (386) operates the compressor machine (10*a*) according to a predetermined speed curve until the lowest speed range (NDB) of the at least one screw rotor is reached, which prevents damage in the region of at least one of the screw rotors.

80. A compressor machine in accordance with embodiment 78 or 79, wherein the control unit (372) monitors the operation termination mode (386) with a speed monitoring mode (388) until the lowest speed range (NDB) of the at least one screw rotor (36, 38) is reached.

81. A compressor machine in accordance with embodiment 80, wherein the control unit (372), when the lowest speed range (NDB) preventing damage in the region of the at least one of the screw rotors (36, 38) is reached, transitions to a holding mode (390) in which the lowest speed range (NDB) of the at least one screw rotor (36, 38) is maintained for a holding time (HT).

82. An expander machine in accordance with embodiments 50 to 72, wherein the operation control unit is configured as an expander operation control unit (440) and has an inverter device (460) which has a grid converter (462) which, for its part, is connected to an AC supply grid (444) and feeds energy from the supply grid into a DC link (464) or feeds energy from the DC link (464) into the supply grid (444), wherein the expander operation control unit (440) has a compressor converter (468) which feeds a motor (404) for a compressor (402) for a circuit (400) operated in a thermodynamic cycle from the DC link (464), and wherein the expander operation control unit (440) has a generator converter (470) which feeds energy supplied by the generator unit (132*b*) into the DC link (464).

83. An expander machine in accordance with embodiment 82, wherein the generator converter (470) specifies a start-up behavior of the generator unit (132*b*) through the coupling to the DC link (464), in particular briefly energizing the generator unit (132*b*) during start-up.

84. An expander machine in accordance with embodiments 82 or 83, wherein the expander operation control unit (440) comprises a control unit (472) controlling the inverter device (460).

85. An expander machine in accordance with embodiment 84, wherein the control unit (472) controls the generator converter (470).

86. An expander machine in accordance with embodiment 84 or 85, wherein the control unit (472) controls the grid converter (462).

87. An expander machine in accordance with embodiments 82 to 86, wherein the control unit (472) controls the compressor converter (468).

88. An expander machine in accordance with embodiments 82 to 87, wherein the control unit (472), by controlling the grid converter (462), the compressor converter (468) and the generator converter (470), controls the motor (404) in respect of the speed of the motor (404) for the compressor (402) and the generator unit (132*b*) in the normal operating mode (502) in accordance with a signal (474) for reaching and maintaining the high pressure at the high-pressure connection (84) of the expander machine (10*b*), and feeds the electrical power generated by the generator unit (132*b*) to the DC link (464), wherein the grid converter (462) feeds the excess electrical power from the DC link (464) to the supply grid (444).

89. An expander machine in accordance with embodiments 82 to 88, wherein the control unit (472) monitors the normal operating mode (502) in a monitoring mode (504) to determine whether a possible shutdown signal (476, 468, 492, 494 and 496) is present and, if such a signal is present, initiates a transition from the normal operating mode (502) to an operation termination mode (506), in which the generator unit (132*b*) contributes according to a predetermined speed curve until the lowest speed range (NDB) of the at least one screw rotor (36, 38), which prevents damage in the region of at least one of the screw rotors (36, 38), is reached.

90. An expander machine in accordance with embodiments 82 to 89, wherein the control unit (402) monitors the operation termination mode (506) with a speed monitoring mode (588) until the lowest speed range (NDB) of the at least one screw rotor (36, 38) is reached.

91. An expander machine in accordance with embodiments 82 to 90, wherein the control unit (472), when the lowest speed range (NDB) of the at least one screw rotor (36, 38) is reached, transitions to a holding mode (590) in which the speed of the at least one screw rotor in the lowest speed range is maintained during a holding time (HT) by control of the generator converter (470).

92. An expander machine in accordance with embodiments 82 to 91, wherein the control unit (472), after the end of the holding mode (390), transitions to a waiting mode (512) in which presets are made for a re-start of the generator unit (132*b*) by the generator converter (470), wherein the waiting mode (512) is monitored by a waiting monitoring mode (514), which initiates a transition to a start-up mode (516) in the event of a signal for a re-start.

93. An expander machine in accordance with embodiment 92, wherein the control unit (472) controls the generator converter (470) in the start-up mode (516).

94. A compressor/expander machine in accordance with preceding embodiments 50 to 93, wherein in at least one of the screw rotors (36, 38) a lubricant support film (210) is built up between the high-pressure-side end faces (122, 124) of the screw rotors (36, 38) and the end wall surfaces (126, 128) of the machine housing (10) by means of a lubricant supply unit (222, 224).

95. A compressor/expander machine in accordance with embodiment 94, wherein the lubricant support film (210) is maintained by supplying lubricant to one of the support regions (232, 234) extending between the high-pressure-side end face (122, 124) of the particular screw rotor (36, 38) and the end wall surface (126, 128) and between the innermost diameter (242, 244) of the high-pressure-side end face (122, 124) and a radially outer circular boundary line (246, 248).

96. A compressor/expander machine in accordance with embodiment 95, wherein the circular boundary line (246, 248) runs in particular at a radial spacing from the screw rotor axis (52, 54) which at most corresponds to the radial spacing of an innermost root (252, 254) of a particular screw rotor contour (42, 44) from the corresponding screw rotor axis (52, 54).

97. A refrigerant circuit (300), in particular of a cooling device or a heat pump or a vapor compression device, comprising a heat exchanger (302) in which expanded refrigerant absorbs heat, a compressor machine (10*a*) for compressing the expanded refrigerant and a heat exchanger (322) in which the compressed refrigerant emits heat, and an expansion unit (330) for expanding the compressed refrigerant, wherein the compressor machine (10*a*) is configured in accordance with embodiments 50 to 81.

98. A thermodynamic cycle (400), in particular of an ORC system or a vapor expansion system, comprising a compressor (402) for compressing the working medium, a heat exchanger (412) for heating the working medium, an expander machine (10*b*) for expanding the compressed and heated working medium and a heat exchanger (424) for cooling the expanded working medium, wherein the expander machine (10*b*) is configured in accordance with preceding embodiments 50 to 72 and 82 to 96.

Further features of the invention are the subject of the following description and the drawings of some exemplary embodiments.

DETAILED DESCRIPTION OF THE INVENTION

Figure 1:
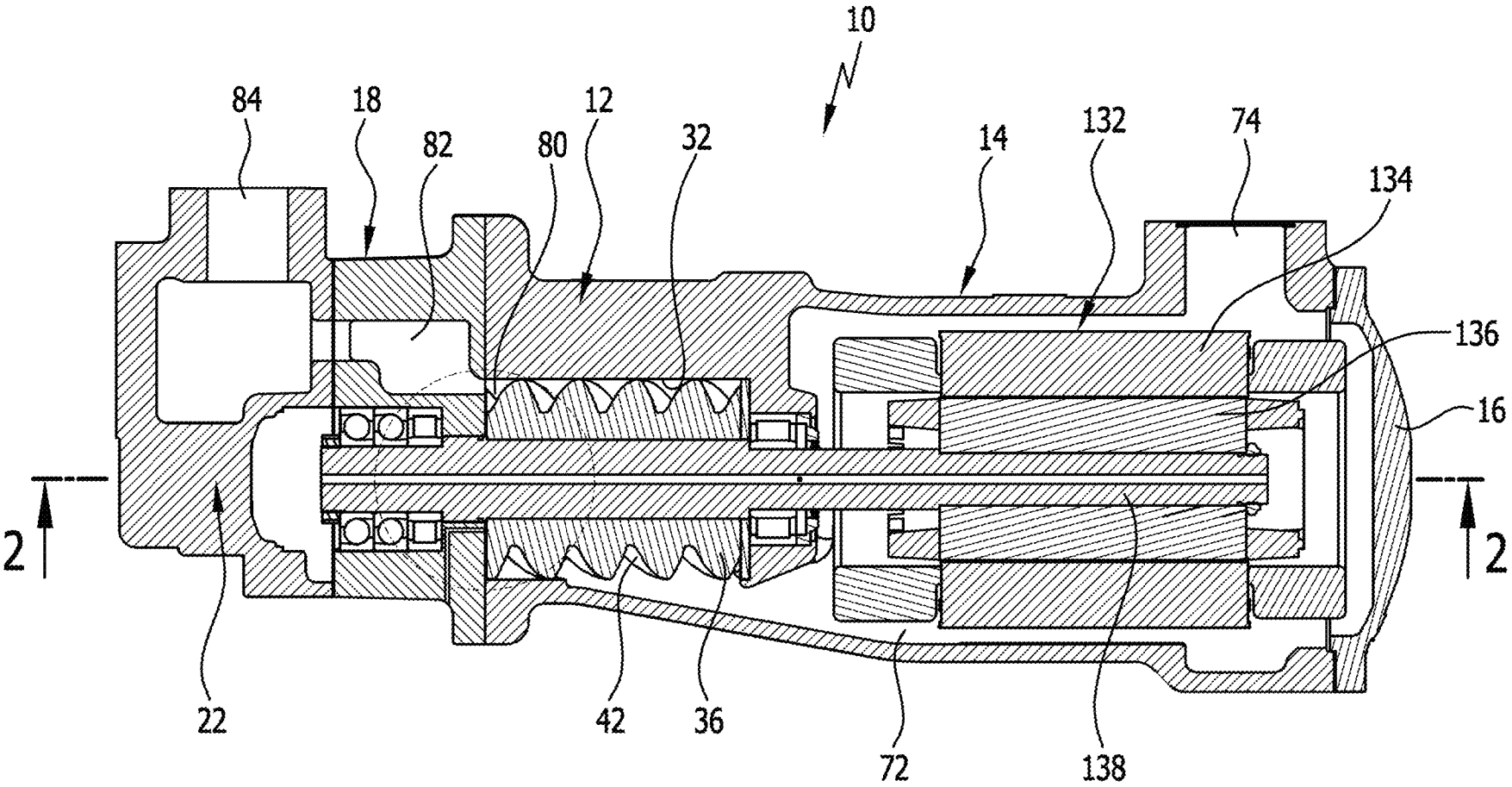
FIG. 1 is a longitudinal section through an exemplary embodiment of a compressor/expander machine according to the invention.
Figure 2:
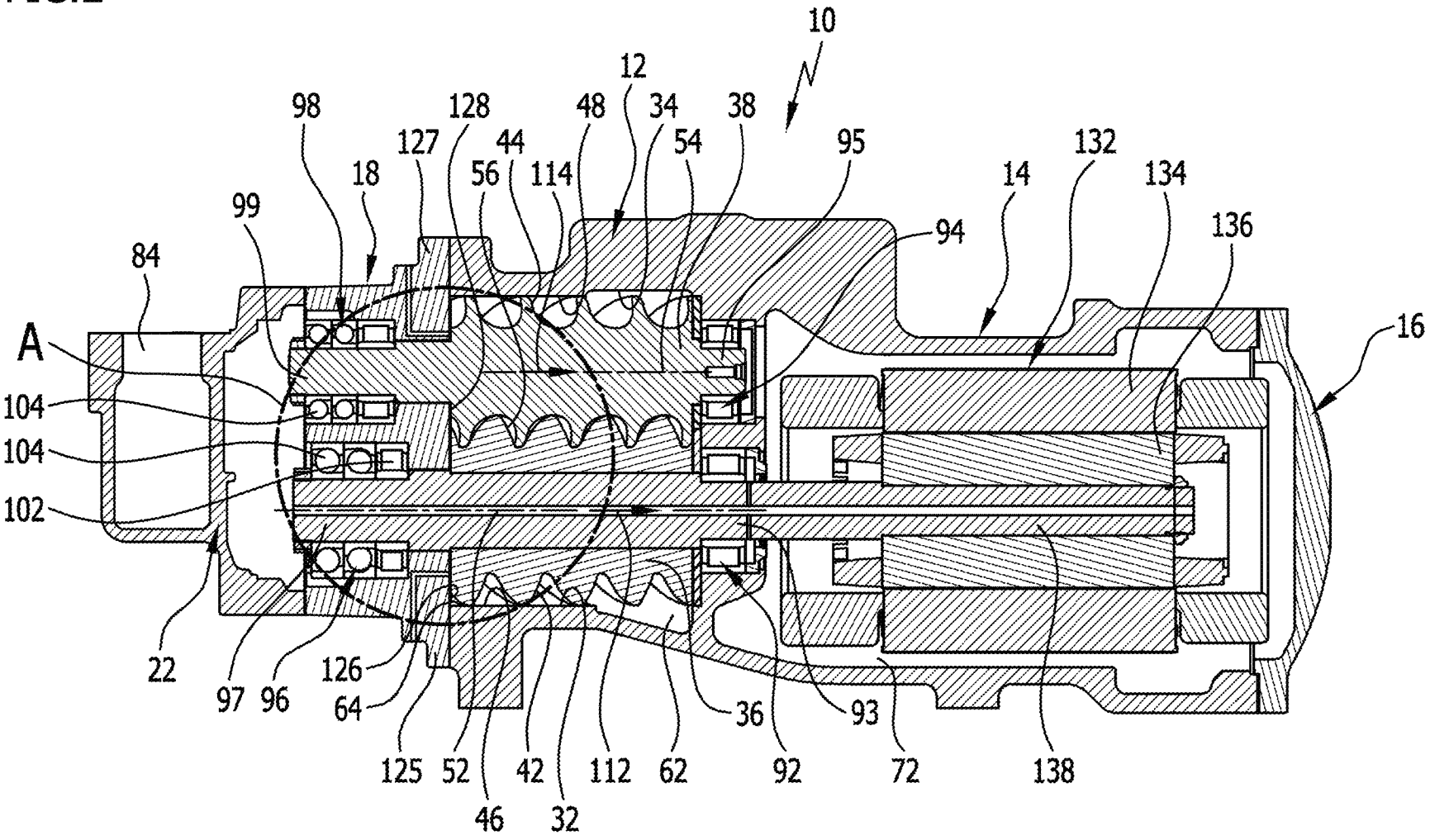
FIG. 2 is a longitudinal section according to line 2-2 in FIG. 1.
Figure 3:
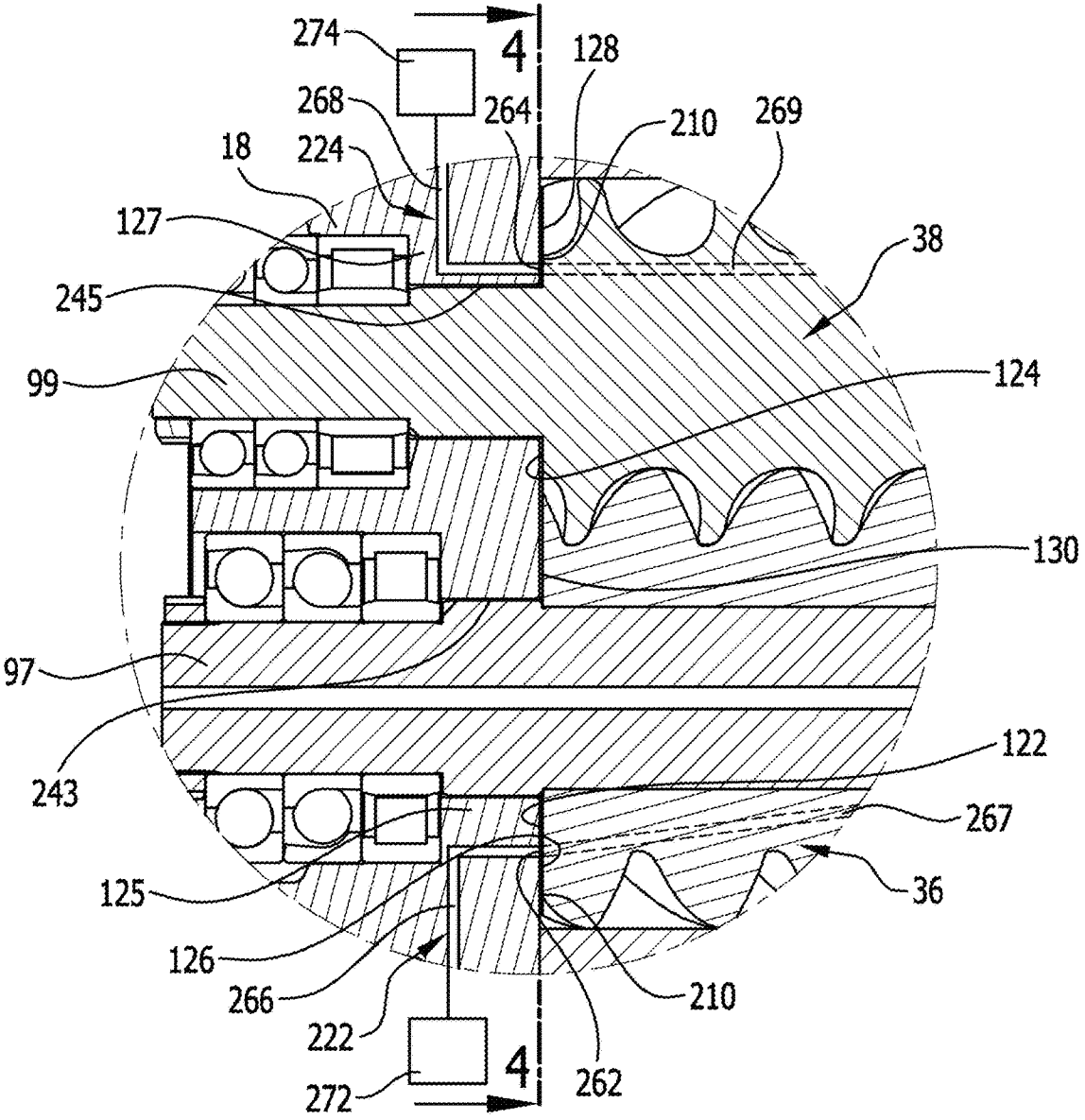
FIG. 3 is an enlarged representation of the region marked with a circle in FIG. 2.
Figure 4:
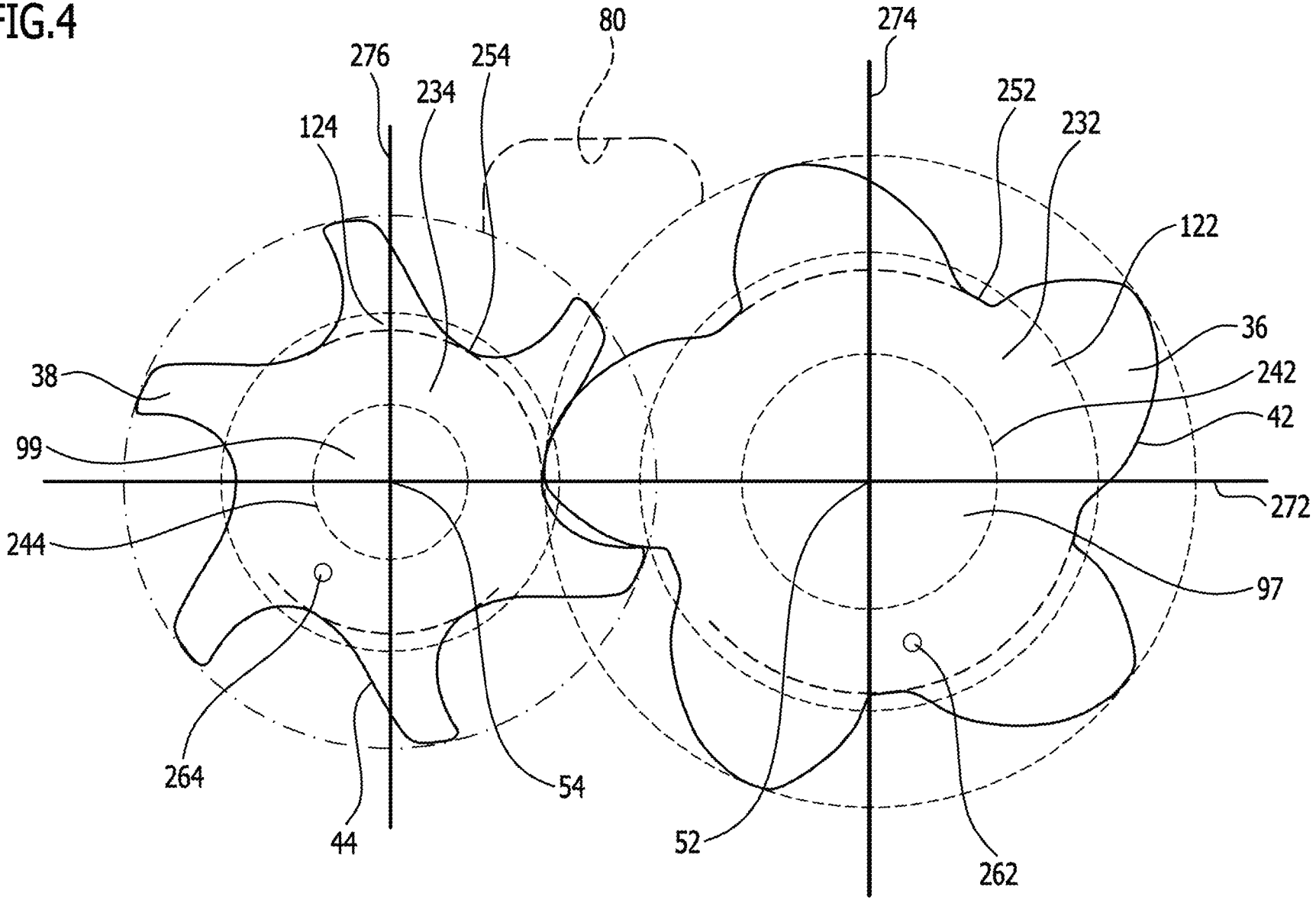
FIG. 4 is a section along line 4-4 in FIG. 3.

A first exemplary embodiment of a machine according to the invention, in particular a compressor/expander machine 10, is shown in FIGS. 1 and 2, with a machine housing 11, which is formed by a screw rotor housing 12 and a motor/generator housing 14, which adjoins one side of the screw rotor housing 12 and which is closed off by an end housing cover 16 on a side opposite the screw rotor housing 12.

On a side of the screw rotor housing 12 opposite the motor/generator housing 14 is a bearing housing 18, which is closed by a bearing housing cover 22 on a side opposite the screw rotor housing 12.

For example, in the screw rotor housing 12 there are provided two screw rotor bores 32, 34, in which two screw rotors 36 and 38 are arranged, which intermesh with their screw rotor contours 42, 44 and interact with wall surfaces 46, 48 of the screw rotor bores 32, 34 in order to form chambers 56 which are enclosed between the screw rotor contours 42, 44 and the wall surfaces 46, 48 when the screw rotors rotate about their respective screw rotor axes 52, 54, wherein these chambers 56 have the maximum possible volume at a low-pressure side 62 adjacent to the screw rotor bores 32, 34, at which the prevailing pressure is detected by a low-pressure sensor 63, and have the smallest volume at a region adjacent to a high-pressure side 64, at which the prevailing pressure is detected by a high-pressure sensor 65.

In the exemplary embodiment shown by way of example, the low-pressure side 62 is located on a side of the screw rotor housing 12 which is associated with the motor/generator housing 14, wherein the low-pressure side 62 is connected by a low-pressure channel 72 which passes through the motor/generator housing 14 and which in turn runs as far as a low-pressure connection 74 of the machine housing 12, wherein the low-pressure connection 74 is preferably connected close to the housing cover 16, so that the low-pressure channel 72 runs between the low-pressure connection 74 and the low-pressure side 62 as far as possible through the motor/generator housing 14 and in particular over the entire length thereof.

In the exemplary embodiment shown by way of example, the high-pressure side 64 is on a side of the screw rotor housing 12 facing the bearing housing 18, wherein the high-pressure side 64 is adjacent to a high-pressure opening 80 of the screw rotor bores 32, 34, which is followed by a high-pressure channel 82 which runs through the bearing housing 18 and enters the bearing housing cover 22 and leads to a high-pressure connection 84 in the machine housing 12, which is arranged, for example, in the bearing housing cover 22.

As shown in FIGS. 1 and 2, the screw rotors 36 and 38 are mounted rotatably about the respective screw rotor axis 52, 54 in the overall housing 10, wherein a respective bearing set 92, 94 is arranged on the low-pressure side 62 for each of the screw rotors 36, 38 and a bearing set 96, 98 is arranged on the high-pressure side for each of the screw rotors 36, 38.

Each of the bearing sets 92, 94, 96, 98 comprises at least one radial bearing 102 and, in addition, each of the bearing sets 92, 94, 96, 98 comprises for each of the screw rotors 36, 38, for example the respective bearing set 96, 98 on the high-pressure side 64, at least one axially acting bearing 104.

In particular, each of the bearing sets 92, 94, 96, 98 is arranged on a bearing receiving region 93, 95, 97, 99 of the respective screw rotor 36, 38.

The axially acting bearings 104 support the screw rotors 36, 38 such that they counteract a force acting on the screw rotors 36, 38 in the direction of the low-pressure side 62, since the pressure difference between the high-pressure side 64 and the low-pressure side 62 acts on the screw rotors such that these have a tendency to move in the directions 112, 114 parallel to the screw rotor axes 52, 54 and away from the high-pressure side 64 in the direction of the low-pressure side 62 and thus enlarge a sealing gap 130 on the high-pressure side, which is present in the operating position of the screw rotors 36, 38 on the high-pressure side 64 between high-pressure-side end faces 122, 124 of the screw rotors 36, 38 and the end wall surfaces 126, 128, formed by end walls 125, 127 of the bearing housing 18, which close the screw rotor bores 32, 34 on the high-pressure side 64, and thus keep them in the size predetermined by the axially acting bearings 104.

Maintaining the operating position and thus the sealing gap 130 between the respective high-pressure-side end face 122, 124 of the respective screw rotor 36, 38 and the respective end wall surface 126, 128, which has a predetermined gap width and is sealed by a lubricant film in conventional compressor or expander machines, is necessary in order to ensure optimum and, in particular, wear-free operation of the compressor/expander machine in the region of the high-pressure-side end faces 122, 124 and the end wall surfaces 126, 128, and therefore the operating position is predetermined by the action of the axially acting bearings 104 on the screw rotors 36, 38.

The screw rotors 36, 38, which rotate about their screw rotor axes 52, 54, are coupled to an electric motor/generator unit which is denoted as a whole by 132 and is arranged in the motor/generator housing 14.

The electric motor/generator unit 132 comprises a stator 134, which is fixedly arranged in the motor/generator housing 14, and a rotor 136, which is surrounded by the stator 134 and arranged on a common drive shaft 138, which passes through both the rotor 136 and the screw rotor 36 and is supported in the bearing sets 92 and 96.

Thus, in this exemplary embodiment, the speed of the screw rotors 36, 38 corresponds to the speed of the motor/generator unit 132.

As shown in FIGS. 1 and 2, the motor/generator unit 132 is arranged so that the low-pressure channel 72 runs at least through certain regions and along the stator 134 and also—when necessary-between the rotor 136 and the stator 134 to cool the electric motor/generator unit 132 by the gas flowing on the low-pressure side.

The screw rotor 36 coupled to the electric motor/generator unit 132 is itself coupled to the screw rotor 38 by the interacting screw rotor contours 42, 44, with the result that the chambers 56 formed between them, depending on the direction of rotation of the screw rotors 36, 38, either move from the low-pressure side 62 to the high-pressure side 64 and compress the gas supplied on the low-pressure side and release it on the high-pressure side 64 or move from the high-pressure side 64 to the low-pressure side 62 in order to thus release the gas supplied on the high-pressure side 64 as expanded gas on the low-pressure side 62.

During starting or stopping processes or in the event of an aborted starting or stopping process or an incorrect direction of rotation of the motor/generator unit 132, it is possible that states occur in which the forces acting on the screw rotors 36, 38 in the directions 112 and 114 become close to zero or possibly negative.

In these cases, it is possible that the sealing gap 130 is reduced, causing the high-pressure side end faces 122, 124 of the screw rotors 36, 38 to come into contact with the end wall surfaces 126, 128, resulting in abrasion or heating, in certain cases overheating and consequently damage to the high-pressure side end faces 122, 124 and/or the end wall surfaces 126, 128 or the screw rotor contours 42, 44 of the screw rotors, since the axially acting bearings 104 are only effective in the directions 112 and 114 and not in the directions opposite to the directions 112, 114.

In order to prevent a reduction in the sealing gap 130 and in particular contact between the high-pressure end faces 122, 124 of the screw rotors 36, 38 and the end wall surfaces 126, 128, for example, a lubricant support film 210 is built up between the end faces 122, 124 of the screw rotors 36, 38 and the end wall surfaces 126 and 128 of the machine housing 10, wherein the lubricant support film 210 is generated by lubricant supply units 222, 224 which supply lubricant to the lubricant support film 210 in order, by this permanent lubricant supply, to avoid a reduction of the sealing gap at least in the operating phases of the machine in which a risk of such a reduction exists.

For example, in a first exemplary embodiment of this concept, the lubricant support film 210 is primarily formed between at least one of the support regions 232 and 234 of the screw rotors 36, 38 that run at a radial spacing from the respective screw rotor axis 52, 54 that extends from the innermost diameter 242, 244 of the respective high-pressure-side end face 122, 124 of the respective screw rotor 36, 38 to a radially outer circular boundary line 246, 248.

For example, it is sufficient to provide such a lubricant support film 210 for the male screw rotor 36 connected to the motor/generator unit 312.

However, it is even more advantageous to provide such a lubricant support film 210 for both screw rotors 36, 38.

The inner diameter 242, 244 is preferably defined by an outer diameter of the respective bearing receiving region 97, 99 which extends over the respective high-pressure-side end face 122, 124 through the bores 243, 245 in the end walls 125 and 127 and then into the respective bearing set 96, 98 of the respective screw rotor 36, 38 of which the bearing set 96, 98 is arranged in the bearing housing 18.

The circular boundary line 246, 248 lies radially outside the innermost diameter 242, 244 on the high-pressure-side end face 122, 124 and preferably extends at a radial spacing from the respective screw rotor axis 52, 54 which at most corresponds to the radial spacing of the innermost root 252, 254 of the respective screw contour 42, 44 from the respective screw rotor axes 52, 54.

Thus, the support face 232, 234 is an annular disk-shaped region closed in the circumferential direction around the respective screw rotor axis 52, 54, so that the lubricant support film 210 is not interrupted by the rotating screw rotors through parts of the screw contours 42, 44 in the circumferential direction.

In order to supply the lubricant to the lubricant support film 210, the supply units 222, 224 guide the lubricant to at least one lubricant supply opening 262, 264, from which the lubricant can flow into the respective support regions 232, 234.

For example, first lubricant supply openings 262, 264 may be arranged to directly face the respective support face 232, 234, either by having the respective supply openings 262, 264 arranged in the bearing housing 18 so that the respective lubricant supply openings 262, 264 are located in the respective end wall surface 126, 128.

In this case, the respective lubricant supply unit 222, 224 is provided with a channel 266, 268 which extends through the bearing housing 18 to the respective lubricant supply openings 262, 264.

The channel 266, 268 is then connected, for example, to a lubricant reservoir 272, 274 of the respective lubricant supply unit 222, 224.

Alternatively, however, the lubricant supply openings 262, 264 can be arranged within the high-pressure end faces 122, 124 of the respective screw rotor 36, 38 and in this case the respective channels 267, 269 run through the respective screw rotors 36, 38.

Figure 5:
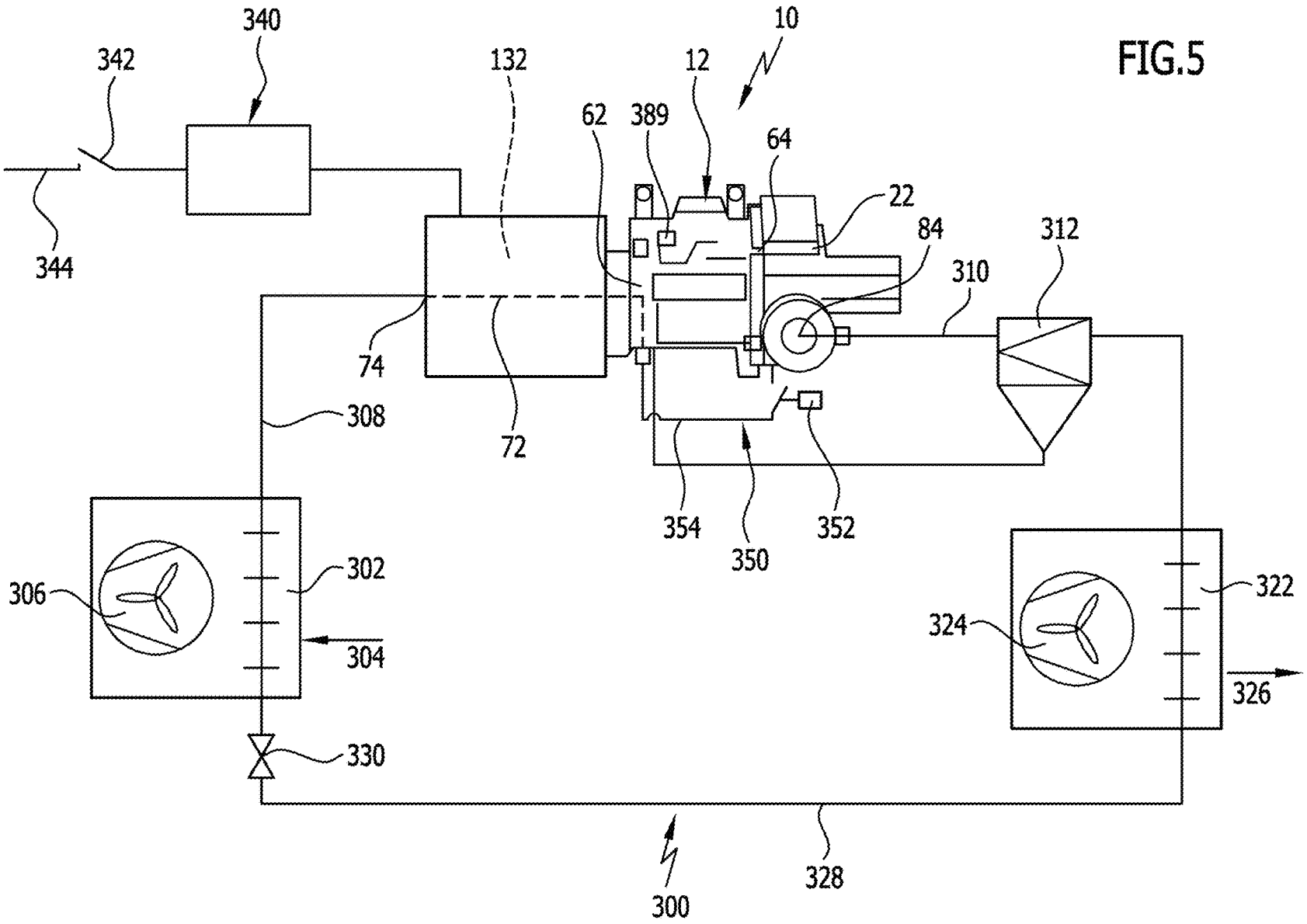
FIG. 5 is a representation of the use of a compressor/expander machine according to the invention as a compressor machine in a refrigerant circuit.

A first possible use of the compressor/expander machine 10 according to the invention, shown in FIG. 5, is that the machine is used as a compressor machine 10*a* in a refrigerant circuit denoted as a whole by 300, for example a cooling system or a heat pump, in which an expanded refrigerant in a heat exchanger 302 absorbs heat from a heat flow 304, which is guided through the heat exchanger 302, for example by means of a fan 306.

The refrigerant then flows via a refrigerant supply conduit 308 to the low-pressure connection 74 of the compressor machine 10, which is arranged, for example, on the housing cover 16, so that the refrigerant flows via the low-pressure channel 72 to the low-pressure side 62 of the screw rotor housing 12, is compressed by the screw rotors 36, 38 driven by the motor unit 132*a* in interaction with the wall surfaces 46, 48 and exits on the high-pressure side 64 via the high-pressure opening 80 and then flows to the high-pressure connection 84.

The compressed refrigerant then leaves the compressor machine 10*a* via a high-pressure conduit 310, flows through, for example, a lubricant collector 312 and then enters the heat exchanger 322, in which the refrigerant, for example assisted by a fan 324, delivers a heat flow 326 so that the refrigerant then cooled thereby is fed via a supply conduit 328 to an expansion unit 330, in which the refrigerant expands and is then fed back to the heat exchanger 302 to absorb heat from the heat flow 304.

The motor unit 132*a* is operated here with a compressor operation control unit 340, which is connected, for example, via a switch 342 to a conventional, for example three-phase AC supply grid 344.

Furthermore, for example, the refrigerant circuit 300 is also formed such that it has a pressure relief 350 which has a pressure relief conduit 354 which connects the low-pressure side 62 to the high-pressure side 64 and can be switched on and off by means of a switching valve 352, wherein the pressure relief conduit 354 can connect the low-pressure side 62 to the high-pressure side 64 or also the low-pressure connection 74 to the high-pressure connection 84.

Figure 6:
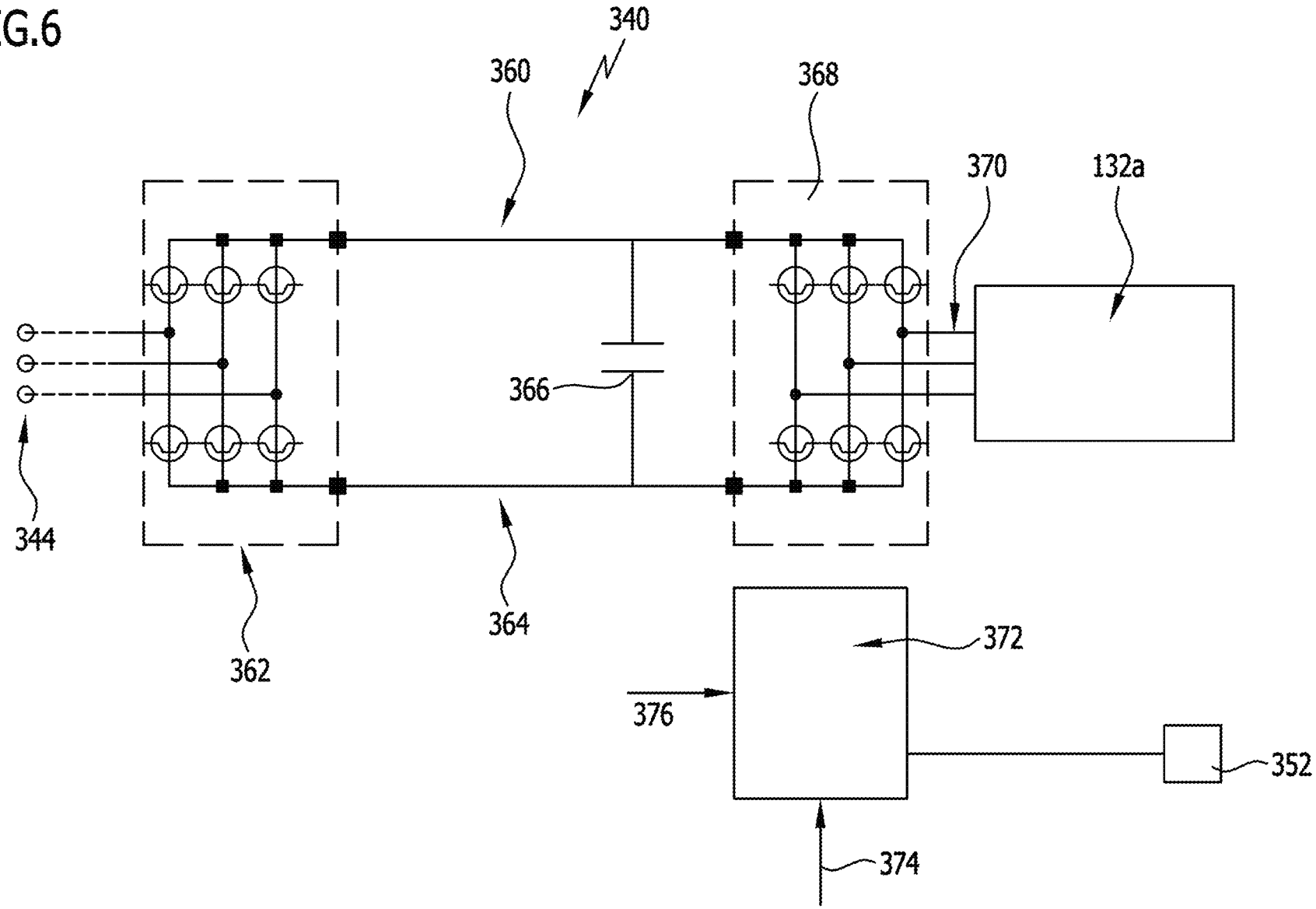
FIG. 6 is a schematic representation of the operation control unit shown in FIG. 5 with the associated inverter device.

As shown in FIG. 6, the compressor operation control unit 340 comprises an inverter device 360, which has a rectifier 362 that generates a DC voltage from the three phases of the AC supply grid 344 and feeds this to a DC link 364, in which power is stored by a capacitor 366.

The DC voltage of the DC link 364 is then converted by a controllable converter 368 into a variable-frequency supply voltage at an output 370 of the converter 368, so that the motor unit 132 of the compressor machine 10*a* can be operated with variable frequency.

For example, the motor unit 132*a* comprises an asynchronous motor fed by three phases of the output 370, but it is also possible to use a permanent magnet motor instead of the asynchronous motor.

The converter 368 can be controlled by a control unit 372, which is comprised by the compressor operation control unit 340 and may also be integrated into the converter 368, and which is able to predetermine the speed of the motor unit 132 by predetermining the frequency of the supply voltage at the output 370.

Control unit 372 comprises as known by a person skilled in the art a processor with a memory in which programs for the various modes of operation as explained in the following are stored and also with inputs units for receiving signals detected and output units for generating control signals according to the mode of operation.

Furthermore, the control unit 372 is also able, for example, to control the switching valve 352 of the pressure relief 350, which makes it possible to equalize the pressure between the high-pressure side 64 and the low-pressure side 62 by connecting the pressure relief conduit 354.

Figure 7:
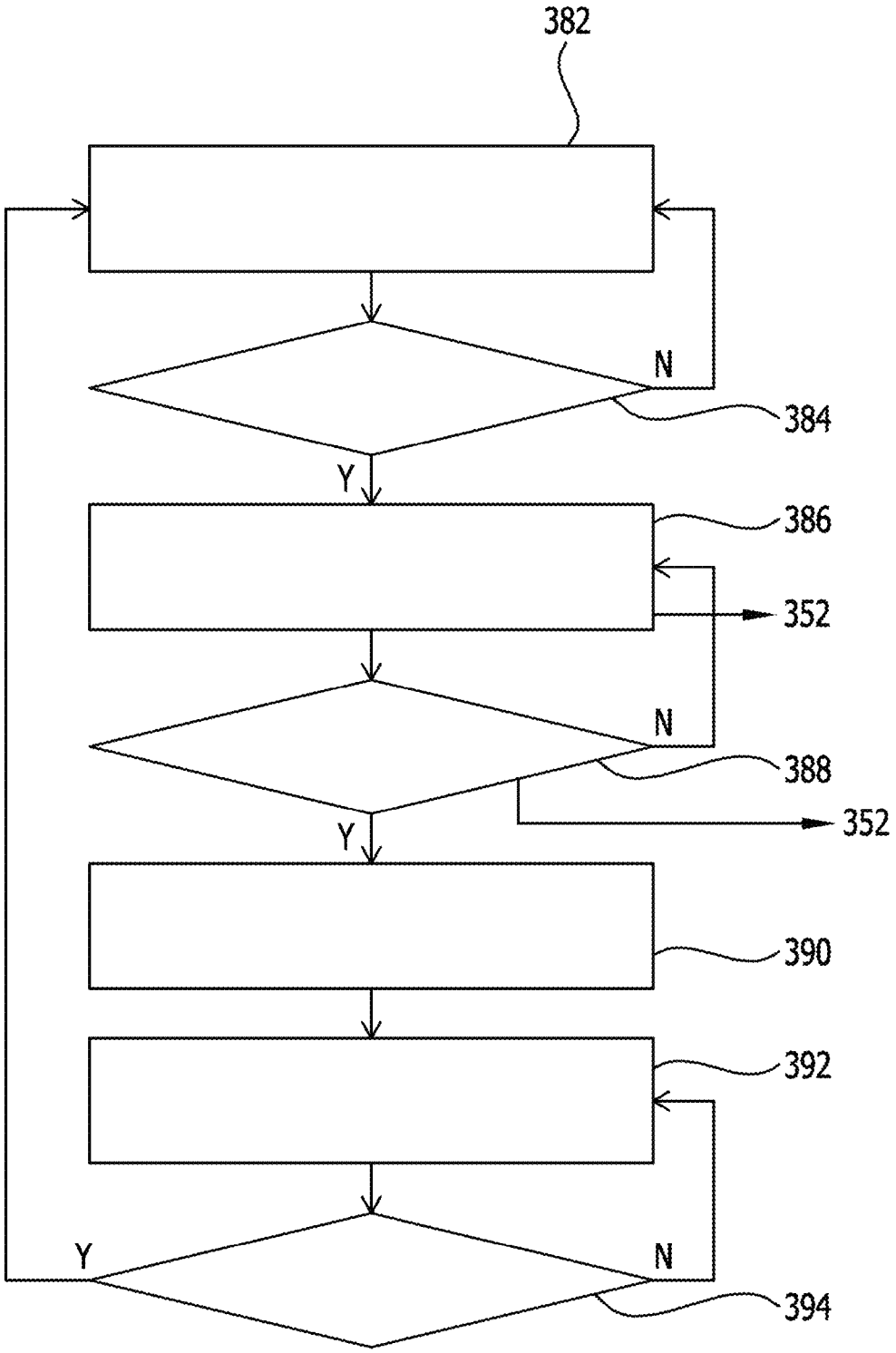
FIG. 7 is a flow diagram of the operating modes of a control unit of the operation control unit according to FIG. 5.

The control unit 372 operates according to the following operating modes shown in FIG. 7.

In a normal operating mode 382, the motor unit 132*a* is operated at the speed predetermined by a signal 374, generated by a higher-level control system for the operation of the refrigerant circuit 300.

The normal operating mode 382 is constantly monitored by a monitoring mode 384, which checks whether normal operation should be maintained or terminated.

In the normal operating mode 382, maintenance of the high-pressure-side sealing gap 130 is ensured, as described above. Problems with abrasion or heating or overheating of the end faces 122, 124 and the end wall surfaces 126, 128 occur in particular when the motor unit 132 is switched off.

If the control unit 372 determines in the monitoring mode 384 that normal operation is to be terminated on the basis of one of these transmitted shutdown signals 376, an operation termination mode, in particular a braking mode, 386, is activated, in particular in order to avoid the problems described above by reduction of the sealing gap 130, in which operation termination mode the converter 368 is operated in such a way that it brakes the motor unit 132*a* and thus reduces its speed.

The shutdown signal 376 may be by a regular shutdown signal generated by the higher-level control system for the operation of the refrigerant circuit 300.

However, the shutdown signal 376 can also be a shutdown signal generated by a malfunction occurring in the refrigerant circuit 300.

In particular, the control unit 372 receives the shutdown signal 376 in the following cases:

in the event of an internal shutdown;

in the event of an external shutdown;

and in the event of an emergency stop or in the event of a fault in the region of the heat exchanger 302 and/or 322 or in the event of a fault in the expansion unit 330.

Figure 8:
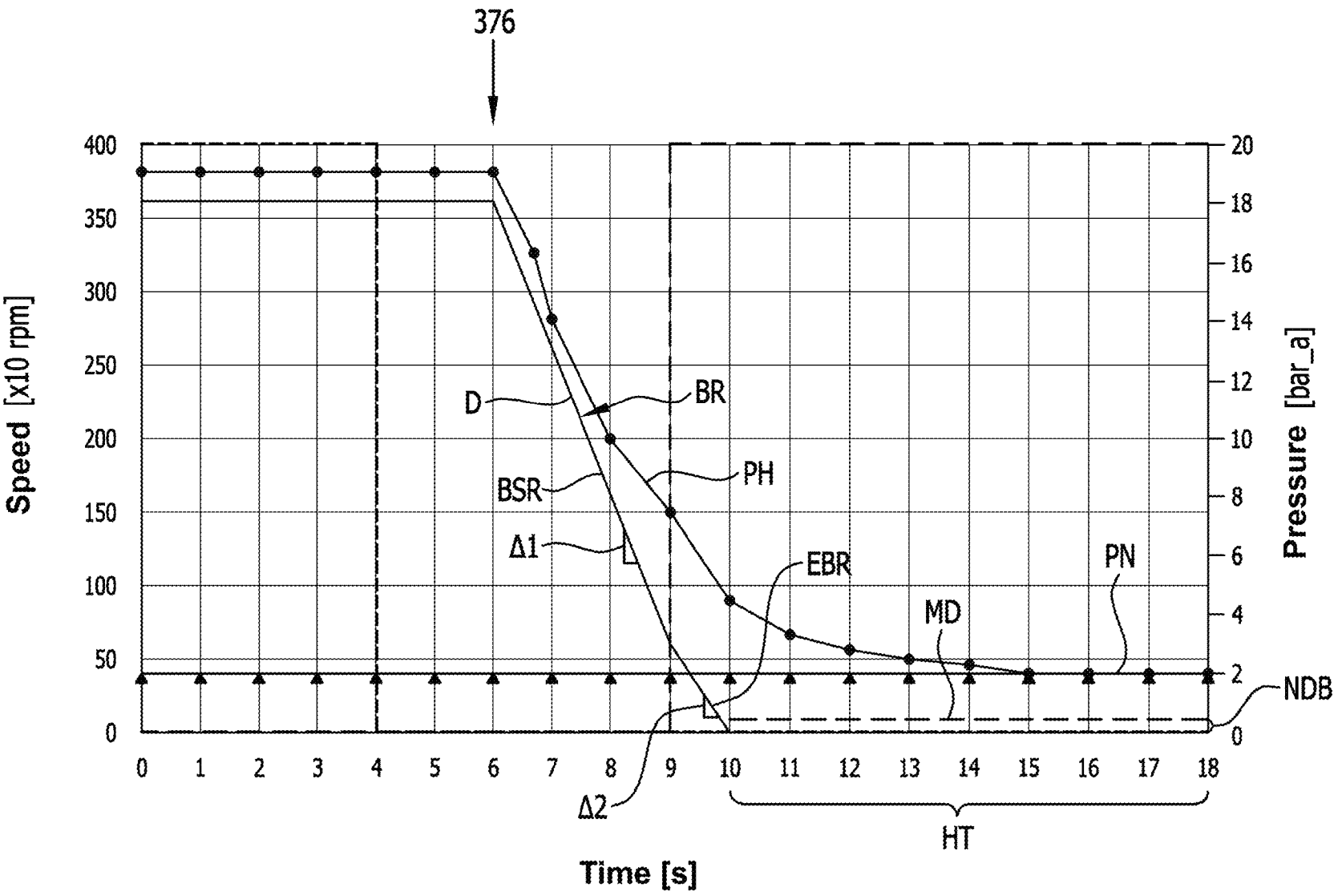
FIG. 8 is a representation of an embodiment of a termination of operation of the compressor machine according to FIGS. 5 to 7.

In the shutdown mode, in particular in the braking mode 386, the speed D of the screw rotors 36, 38 is reduced by the motor unit 132*a* by suitably energizing the windings thereof by means of the converter 368 with a reducing frequency, preferably in accordance with a predetermined braking ramp BR, which defines a course of the decrease in the speed of the motor unit 132*a* and thus also the speed D of the screw rotors 36, 38, as shown in FIG. 8.

Preferably, the braking ramp BR comprises at least a first braking start ramp BSR, which reduces the speed of the motor unit 132*a* with a predeterminable first speed reduction DR1 corresponding to a first speed gradient Δ1 per unit of time by reducing the frequency of the converter 368, and an end braking ramp EBR, which, for example, relates to a lower second speed reduction DR2 corresponding to a second speed gradient Δ2 per unit of time as compared to the braking start ramp BSR, wherein in particular the end braking ramp EBR, starting from an end value of the braking start ramp BSR, reduces the speed to a lowest speed range NDB below a predetermined maximum speed MD, which represents an upper limit of a speed range for its lowest speed range NDB of the screw rotors 36, 38.

The braking mode 386 is monitored here by a speed monitoring mode 388, which uses a sensor 389 to determine whether the speed of the screw rotors 36, 38 that is specified for the speed monitoring mode 388 for the braking ramp BR and, in the case of a direct drive of the screw rotors, also of the motor unit 132*a*, as in the exemplary embodiment shown, is reached, maintained or undershot until the lowest speed range NDB is reached.

The maximum speed MD of the lowest speed range NDB can be less than 10 Hz; for example less than 5 Hz or less than 3 Hz, preferably 0 Hz is reached and maintained.

When the maximum speed MD is reached, the control unit 372 transitions to a holding mode 390, in which the predetermined maximum speed MD or a lower speed is maintained, wherein the holding mode 390 is maintained for a defined period of time, for example several seconds, preferably more than 5 seconds, better still more than 10 seconds and even better still more than 15 seconds, but expediently less than 1 minute, by suitably energizing the windings of the motor unit 132*a* by means of the converter 368, in order to ensure that both screw rotors 36, 38 maintain the maximum speed MD or even better fall below it, and thus the speed cannot increase again as a result of the pressure conditions prevailing in the compressor machine 10.

In particular, the holding mode 390 is maintained for so long that it can be assumed that in the compressor machine 10 there are no longer any pressure differences acting on the screw rotors 36, 38.

Alternatively, the maintenance of the holding mode can also be determined by detecting the pressure difference between the low-pressure sensor 63 and the high-pressure sensor 65, which must fall below a defined value to end the holding mode.

Once this holding mode 390 has ended, the control unit 372 transitions to a waiting mode 392, in which the presets for re-starting the drive unit 132 are resumed by the converter 368.

This waiting mode 392 is monitored by a waiting monitoring mode 394, which in turn initiates a transition to the operating mode 382 in the event of a signal for a re-start.

In addition, the signal for closing the switching valve 352 to establish a flow through the pressure relief conduit 354 may be generated in the operation termination mode, in particular in the braking mode 386, or only in the holding mode 390, in order to activate the pressure relief 350 of the compressor machine 10 and thus ensure that the screw rotors 36, 38 cannot increase their speed again by a possible pressure difference between the low-pressure side 62 and the high-pressure side 64, in order to prevent damage caused by friction of the forces acting on the screw rotors 36, 38 during rotation of the screw rotors, in particular in the opposite direction to the directions 112 and 114, which cause abrasion or at least heating in the region of the end faces 122, 124 of the screw rotors 36, 38 and the end wall surfaces 126, 128, which can lead to permanent damage, in particular during rotation of the screw rotors 36, 38.

Depending on the use of the compressor machine 10, the targeted braking and holding of the braked state can be supplemented by generating the lubricant support film 210 described above.

Figure 9:
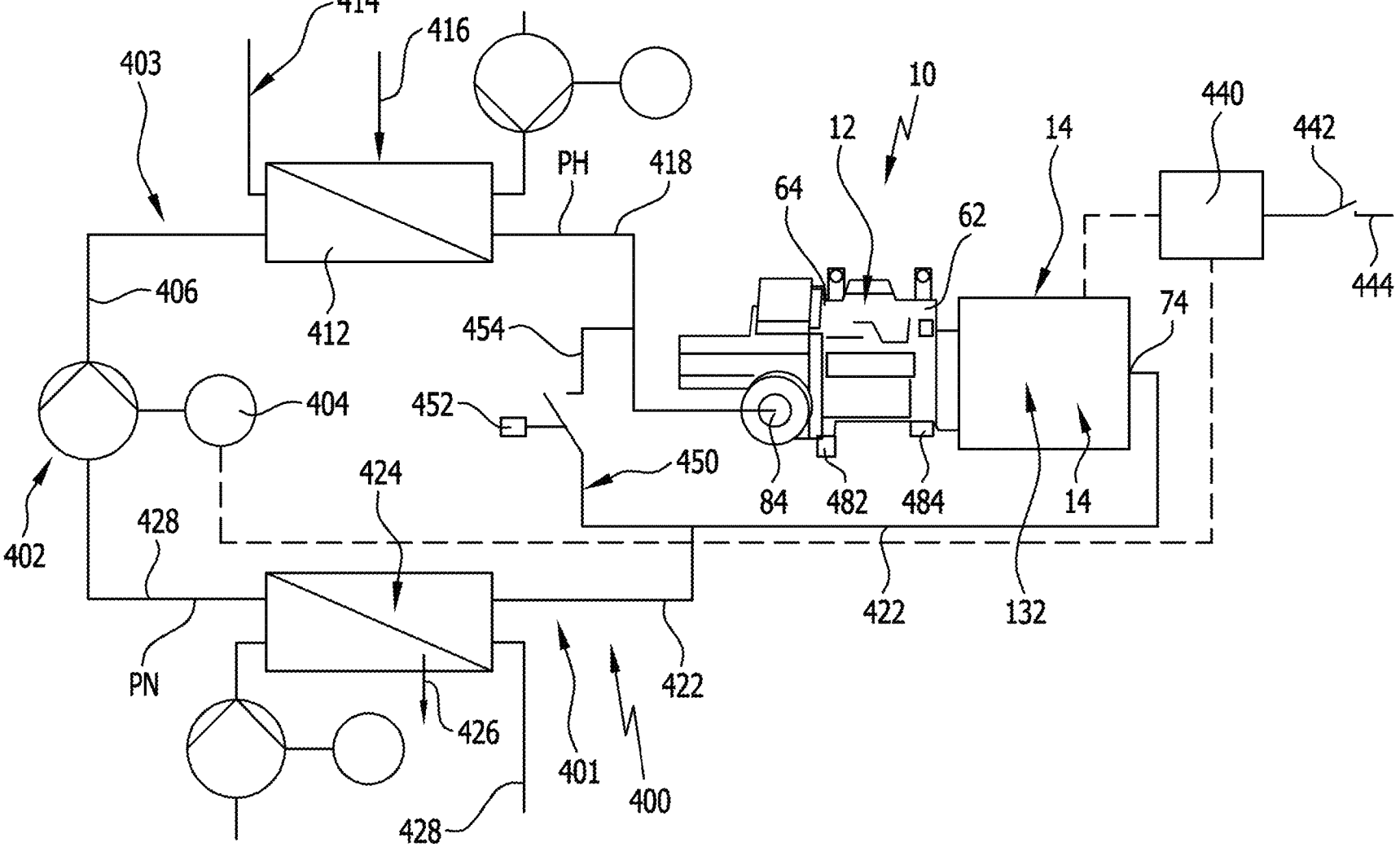
FIG. 9 is a representation of a compressor/expander machine according to the invention as an expander machine in a thermodynamic cycle.

In a second application of the machine according to the invention, it is arranged as an expander machine 10*b* in a circuit 400 for a working medium, in particular in a thermodynamic cycle, preferably in a Rankine circuit 400, in which the working medium, for example an organic medium, is compressed by means of a compressor 402, usually referred to as a feed pump, driven by a motor 404, starting from a low-pressure side 401 of the circuit 400, and is fed on a high-pressure side 403, via a feed conduit 406, to a heat exchanger 412, in which the working medium receives a heat flow 416, for example from a heat circuit 414, and is thereby additionally heated so that its pressure rises further, as shown in FIG. 9.

The working medium under high pressure PH on the high-pressure side 403 is then fed to the high-pressure connection 84 of the expander machine 10*b* described above by means of a conduit 418 and drives the screw rotors 36 and 38 during the transition from the high-pressure side 64 to the low-pressure side 62, wherein the expanded working medium then flows through the motor housing 14 and exits at the low-pressure connection 74.

Subsequently, the working medium is then fed to a heat exchanger 424 on the low-pressure side 401 via a conduit 422 and releases a heat flow 426 to a cooling circuit 428, in which the heat exchanger 424 is also arranged.

The working medium cooled on the low-pressure side 401 and expanded to low pressure is then fed back to the compressor 402 via a conduit 430.

In addition, the expander machine 10*b* is also provided with a pressure relief 450, which, for example, connects the low-pressure connection 74 to the high-pressure connection 84 and has a switching valve 452 and a pressure relief conduit 454, which, for example, connects the conduit 418 to the conduit 422.

In this case, the housing 14 is a generator housing.

The generator unit 132*b* arranged in this generator housing 14 interacts with an expander operation control unit 440, which is connected, for example, via a switch 442, for example, to a conventional three-phase AC supply grid 444 and feeds energy into the supply grid 444 when the circuit 400 is operational.

Figure 10:
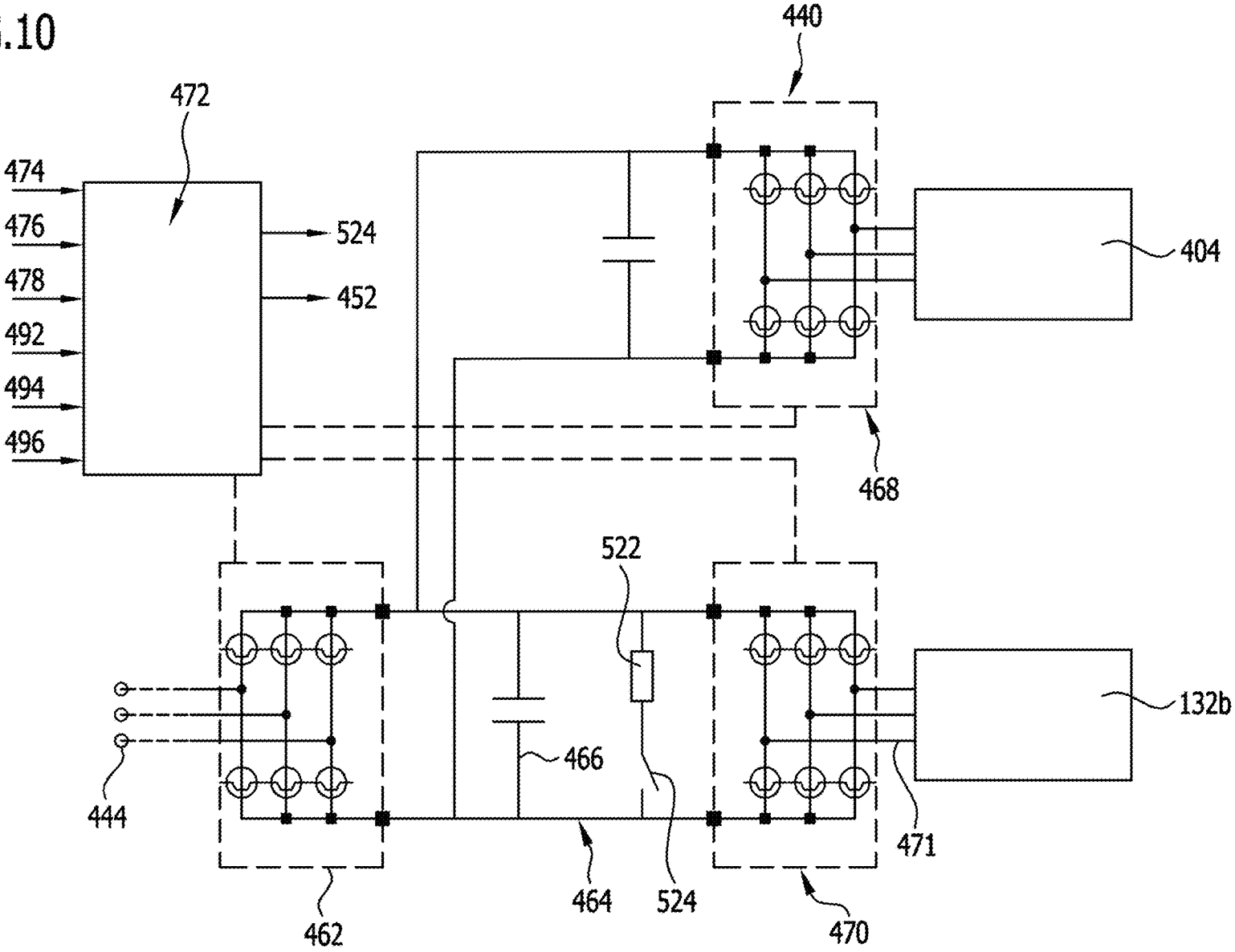
FIG. 10 is a representation of the operation control unit according to FIG. 9 with a control unit and the inverter device controlled thereby.

As shown in FIG. 10, the expander operating unit 440 comprises an inverter device having a grid converter 462 connected to the AC supply grid 444 and feeding a DC link 464 that stores energy through a capacitor 466.

Furthermore, a compressor converter 440, which is connected to the DC link 464, is provided for operating the motor 404 to drive the compressor 402.

In addition, a generator converter 470 is also provided to operate the generator unit 132*b*.

To start the circuit 400 for the working medium, the grid converter 462 acts as a rectifier to feed the DC link 464 from the supply grid 444, wherein the compressor converter 468 draws power from the DC link 464 to operate the motor 404 for the compressor 402 to operate the motor 404 at a suitable speed.

For this purpose, the compressor converter 468 is controlled by a control unit 472, which receives a signal 474 from a higher-level control system for the circuit 400, which represents a target specification for the speed of the motor 404 and thus of the compressor 402 in order to achieve and maintain the high pressure at the high-pressure connection 84 of the expander machine 10*b*.

Control unit 472 comprises as known by a person skilled in the art a processor with a memory in which programs for the various modes of operation as explained in the following are stored and also with input units for receiving signals detected and output units for generating control signals according to the mode of operation.

After a sufficiently great high pressure PH has been built up in the circuit 400 for the working medium, in particular also with the supply of the heat flow 416 to the working medium, a sufficiently great pressure difference is established between the high-pressure connection 84 of the expander machine 10*b* and the low-pressure connection 74 of the expander machine 10*b* and drives the screw rotors 36, 38 and the generator unit 132*b*.

The generator unit 132*b* preferably comprises an asynchronous machine, which is connected to the three-phase connection 471 of the generator converter 470, but it is also possible to use a permanent magnet machine as an alternative.

In the case of an asynchronous machine, it is expedient to use the generator converter 470 when starting the generator unit 132*b* to energize it to a low speed for starting in order to ensure pre-magnetization.

When current is generated by the generator unit 132*b*, it is converted by the converter 470 and fed into the DC link 464.

Since, in the circuit 400 for the working medium, the power generated by the expander machine 10*b* is greater than the power applied by the motor 404 to operate the compressor 402, there is excess power in the DC link 464, so that in this case the grid converter 462 is operated by the control unit 472 so that electrical power from the DC link 464 is fed into the supply grid 444, wherein the DC link 464 simultaneously still feeds the converter 464 to drive the motor 404.

The control unit 472 monitors a signal 476 relating to the grid stability of the supply grid 444, a signal 468 relating to a sufficiently large pressure ratio or a sufficiently large pressure difference between the high-pressure side 64 and the low-pressure side 62 during operation of the expander machine 10*b*, wherein this is measured by sensors 482 and 484, which are associated, for example, with the high-pressure side 64 and the low-pressure side 62, respectively, and a high-pressure signal 496, which indicates the high pressure during operation of the expander machine, measured, for example, by the sensor 482, wherein these signals trigger a shutdown of the generator unit 132*b* in the same way as the shutdown signal or the emergency stop signal 494 when the pressure falls below a respective predetermined limit value.

Figure 11:
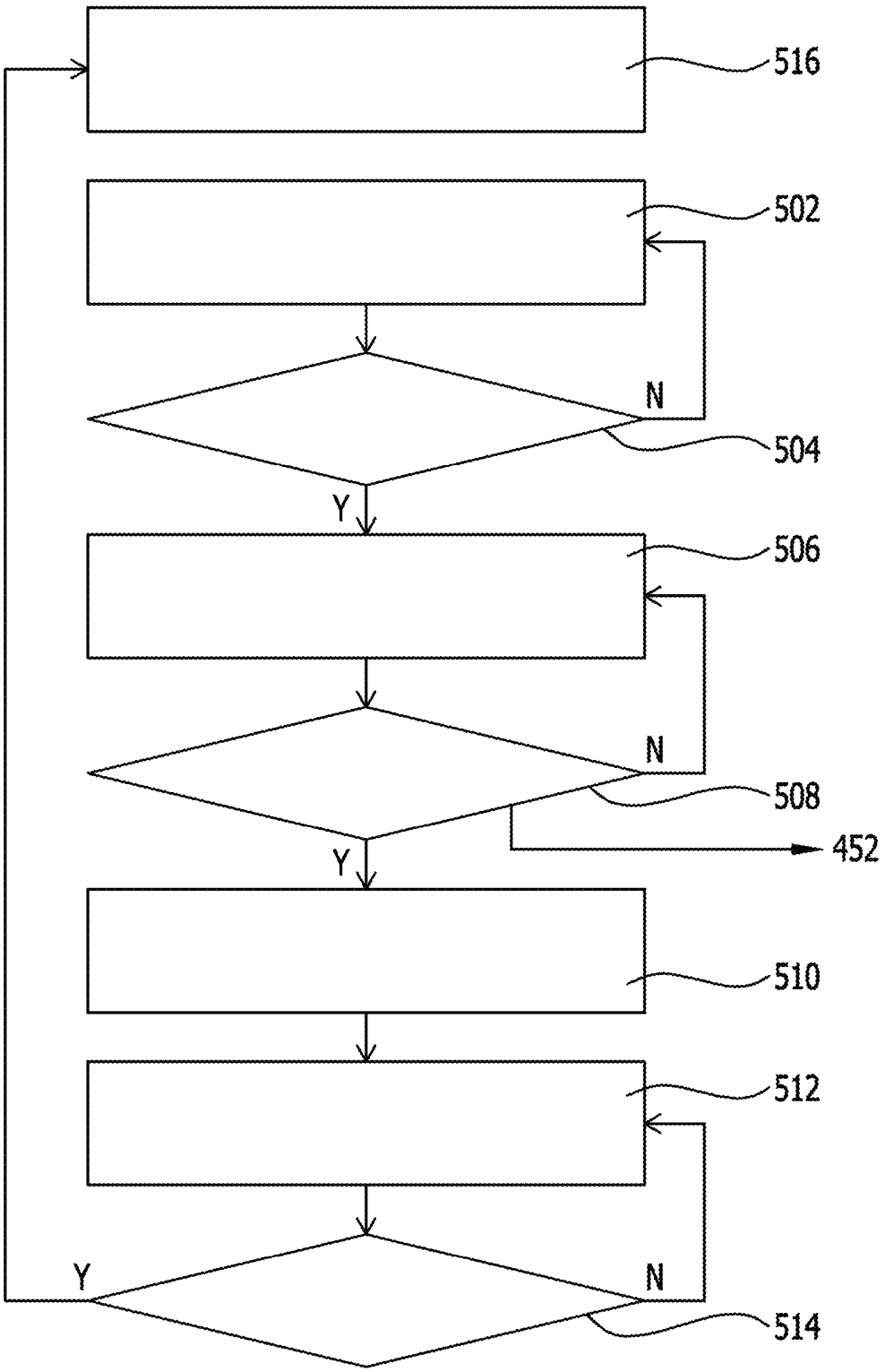
FIG. 11 is a flow chart of the operating modes of the control unit according to FIG. 10.

According to the invention, the generator converter 470 for the generator unit 132*b* is operated using the flow chart shown in FIG. 11.

In a normal operating mode 502, the generator converter 470 is operated in such a way that it feeds the generated electrical power into the DC link 464 in accordance with the speed of the generator unit 132*b*, which is then fed from the grid converter 462, minus the power for the motor 404, into the supply grid 444 at the frequency corresponding to this.

At the same time, a monitoring mode 504 permanently monitors whether the signal 476 relating to the supply grid 444, the signal 468 relating to the required pressure ratio at the expander machine 10*b*, and the signal 496 relating to the high pressure in the circuit 400 of the working medium or the absence of the shutdown signal 492 or the emergency signal 494 justify maintaining the normal operating mode 502 or whether a transition to a shutdown mode 506 is required, in particular in order to avoid the problems at the sealing gap 130 described above.

In normal operating mode 502, maintenance of the high-pressure-side sealing gap 130 is ensured, as described above. However, problems with abrasion or heating or overheating of the end faces 122, 124 and the end wall surfaces 126, 128 occur in particular when operation of the generator unit 132*b* is stopped.

If this is the case, the generator unit 132*b* is braked in the operation termination mode, in particular the braking mode 506, by controlling the generator converter 470 by means of the control unit 472 by suitably operating the windings of the generator unit 132*b* by means of the generator converter 470 at a reducing frequency using the power available in the DC link 464, wherein, when the AC supply grid 444 is available, the grid converter 462 exchanges the power required for braking between the AC supply grid 444 into the DC link 464.

Figure 12:
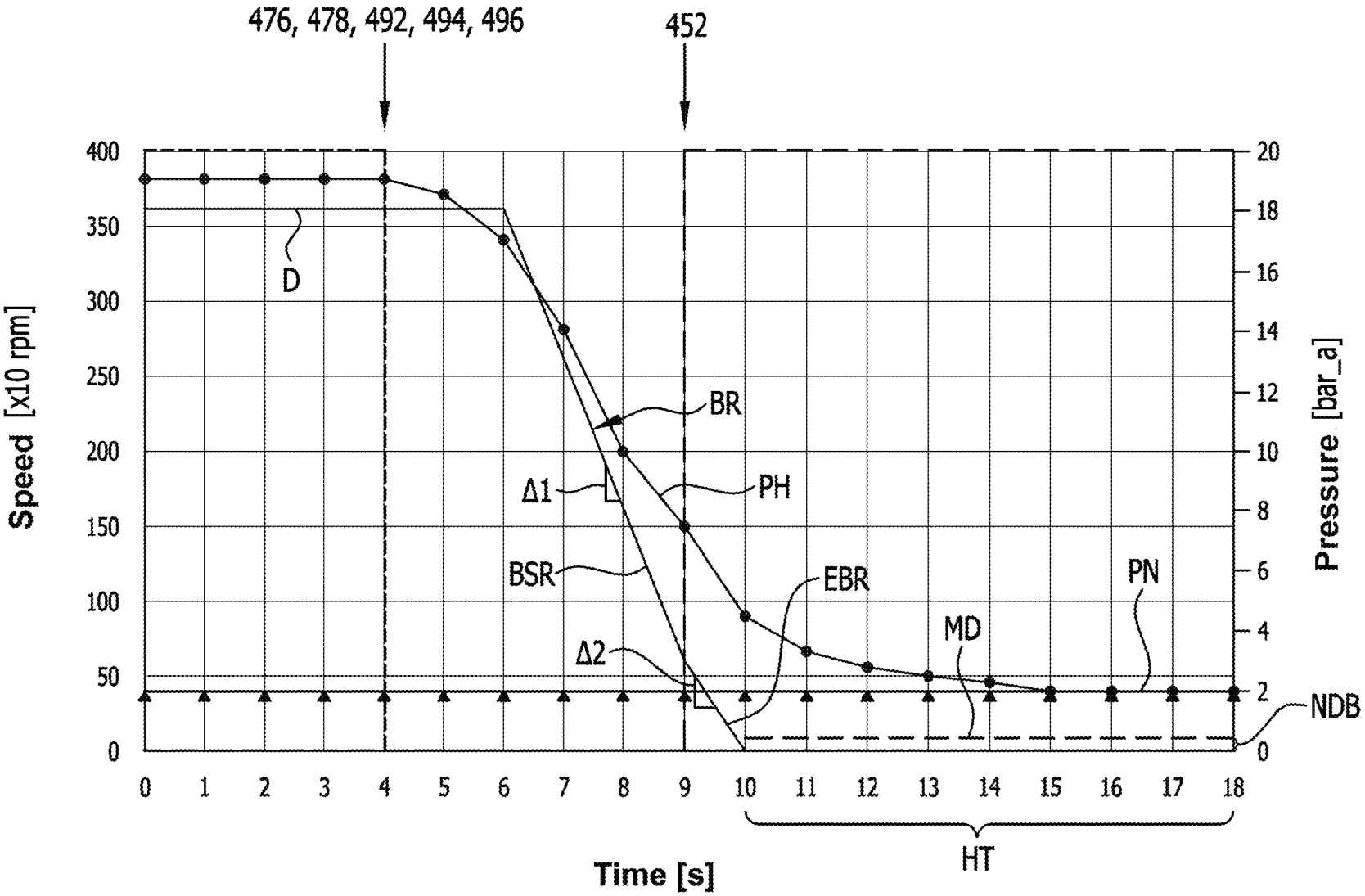
FIG. 12 is a schematic representation of the termination of operation of the expander machine.

In the operation termination mode, in particular braking mode 506, the speed D of the screw rotors 36, 38 is reduced by the generator unit 132, preferably in accordance with a braking ramp BR predetermined by the control unit 472, which predetermines the course of the speed D of the generator unit 132*b* and thus also of the screw rotors 36, 38 over time, as shown in FIG. 12.

In particular, the braking ramp BR starts with a time delay after one of the signals 476, 478, 492, 494, 496 causing the generator unit 132*b* to brake and defines a continuous course of the decrease in the speed of the generator unit 132*b*.

For example, the braking ramp BR comprises at least a first braking start ramp BSR, which reduces the speed of the generator unit 132*b* with a predeterminable speed reduction per unit of time corresponding to a first speed gradient $\Delta 1$ per unit of time by reducing the frequency of the generator converter 470, and an end braking ramp EBR, which, for example, has a lower speed reduction per unit of time corresponding to a second speed gradient $\Delta 2$ per unit of time than the braking start ramp BSR, corresponding to a second speed gradient $\Delta 2$ per unit of time as compared to the braking start ramp BSR, wherein the end braking ramp EBR, starting from an end value of the braking start ramp BSR, reduces the speed of the generator unit 132*b* to a lowest speed range NDB below a predetermined maximum speed MD, which represents an upper limit for a speed range for damage-free operation of the screw rotors 36, 38.

In a monitoring mode 508, it is monitored whether the predetermined maximum speed MD of the screw rotors 36, 38 and—in the case of a direct coupling to the generator unit 132*b*, as in the exemplary embodiment shown—also of the generator unit 132*b*, for example reaches, maintains or drops below less than 5 Hz, in particular less than 3 Hz or even 0 Hz.

If this is the case, it is ensured in a holding mode 510 that the maximum speed MD is maintained or undershot for a holding time HT of at least 2, preferably 5, even better 10 seconds and at most one minute by energizing the windings of the generator unit 132*b* by means of the converter 470.

Alternatively, the holding mode is maintained until the pressure difference, measured by means of the sensors 484, 484, has fallen below a defined value.

To achieve and/or maintain the lowest speed range NDB, in addition to the braking mode 506, for example at a predetermined speed or a predetermined value of the high pressure PH or also still in the holding mode 510, the pressure relief conduit 454 is also closed by the control system 472, in particular the switching valve 452, in order to assist the complete braking and maintenance of the lowest speed range NDB at or below the maximum speed MD by the additional pressure relief to low pressure PN, so that the maximum speed MD is maintained or even better undershot, and thus the screw rotors 36, 38 cannot increase the speed again as a result of the pressure conditions prevailing in the expander machine 10*a*, in order to prevent damage due to friction of the forces acting on the screw rotors 36, 38 during rotation of the screw rotors, in particular in the direction opposite to the directions 112 and 114, which cause abrasion or at least heating in the region of the end faces 126, 128, in particular during rotation of the screw rotors 36, 38, which can lead to permanent damage.

Depending on the use of the expander machine 10*b*, the targeted braking and holding of the braked state can be supplemented by the lubricant support film 210 described above.

However, if an outage of the supply grid 444 occurs, detected by the signal 476, a resistor 522 is provided in the DC link and can be activated by a switch 524 activatable by the control unit 472, in order to pick up the power fed into the DC link by the generator converter 470 if this power cannot be fed back further into the supply grid 444.

Furthermore, the capacitor 466 in the DC link is configured such that the energy stored therein is sufficient to brake the generator unit 132*b* and to maintain it at the maximum speed MD or a lower speed during the holding period HT by suitably energizing the windings of the generator unit 132*b* by means of the generator converter 470.

In particular, the holding mode 510 is maintained for so long that it can be assumed that in the expander machine 10*b* there are no longer any pressure differences acting on the screw rotors 36, 38.

Once this holding mode 510 has ended, the control unit 472 transitions to a waiting mode 512, in which the presets for re-starting the generator unit 132*b* are resumed by the generator converter 470.

This waiting mode 512 is monitored by a waiting monitoring mode 514, which, in the event of a signal for a re-start, in turn initiates a transition to a start-up mode 516, in which a minimum pressure difference between the pressure PH at the high-pressure connection 84 and the pressure PN at the low-pressure connection 74 of the expander machine 10*b* is initially built up by starting the compressor 402, at which minimum pressure difference the screw rotors 36, 38 can still rotate freely.

With the subsequent system start ST, the pressure relief 450 is rendered ineffective with the opening of the switching valve 452, and the speed D of the screw rotors 36, 38 is increased.

The invention claimed is:

1. A method for operating a compressor/expander machine in a circuit for a working medium, wherein the compressor/expander machine has a machine housing with a screw rotor housing, in which at least one screw rotor is arranged between a low-pressure side and a high-pressure side is arranged for compressing/expanding the working medium and is coupled to a motor/generator unit, the method comprising:

in the event of termination of operation of the compressor/expander machine, controlling a speed of the motor/generator unit in accordance with a predetermined speed curve until a lowest speed range of the at least one screw rotor is reached, which prevents damage in the region of the at least one screw rotor.

2. The method in accordance with claim 1, wherein the predetermined speed curve of the motor/generator unit is predetermined by a successive sequence of speed data, wherein the successive sequence of speed data has successive speed values that are constantly decreasing, and wherein the speed values form a braking ramp over time, such that the speed values of the braking ramp decrease over time according to at least one gradient.

3. The method in accordance with claim 2, wherein the braking ramp has a braking start ramp for which the speed values decrease over time according to a first gradient.

4. The method in accordance with claim 3, wherein the braking ramp has, adjoining the braking start ramp, an end braking ramp for which the speed values decrease over time according to a second gradient.

5. The method in accordance with claim 1, wherein controlling the speed of the motor/generator comprises operating the motor/generator unit in the lowest speed range of the at least one screw rotor following the braking ramp.

6. The method in accordance with claim 5, wherein the lowest speed range results in such a low speed of the at least one screw rotor that no abrasion, heating or overheating occurs in the region of the sealing gap between a high-pressure-side end face of the at least one screw rotors and a respective end wall surface.

7. The method in accordance with claim 1, wherein the lowest speed range extends from a speed of the at least one screw rotor from 20 Hz to 0 Hz.

8. The method in accordance with claim 1, further comprising using an operation control unit to maintain the lowest speed range of the at least one screw rotor during a predetermined holding time, wherein the holding time is at least 3 seconds.

9. The method in accordance with claim 8, wherein the holding time is maintained for a period of time after which, in the compressor/expander machine, there are no longer any pressure differences between the low-pressure side and the high-pressure side acting on the at least one screw rotor.

10. The method in accordance with claim 8, wherein the holding time is a maximum of three minutes.

11. The method in accordance with claim 1, further comprising using an operation control unit to maintain the lowest speed range of the at least one screw rotor until there are no longer any pressure differences between the low-pressure side and the high-pressure side in the compressor/expander machine that have an accelerating effect on the at least one screw rotor.

12. The method in accordance with claim 11, wherein the operation control unit operates in a normal operating mode during normal operation of the compressor/expander machine.

13. The method in accordance with claim 12, further comprising monitoring the operation control unit in the normal operating mode by via a monitoring mode which detects signals which require termination of operation of the compressor/expander unit, and transitioning the operation control unit to an operation termination mode if such a signal is present.

14. The method in accordance with claim 13, further comprising operating the motor/generator unit in the operation termination mode according to the predetermined speed profile to terminate operation of the compressor/expander machine.

15. The method in accordance with claim 13, further comprising monitoring the operation termination mode using a speed monitoring mode, which detects when the lowest speed range of the at least one screw rotor has been reached.

16. The method in accordance with claim 15, further comprising, when the lowest speed range is reached, initiating a transition to a holding mode in which the speed of the at least one screw rotor is maintained in the lowest speed range over a defined holding time, which ensures that no pressure differences acting in an accelerating manner on the at least one screw rotor are present at the end of the holding time.

17. The method in accordance with claim 15, further comprising, when the lowest speed range is reached, initiating a transition to a holding mode in which the speed of the at least one screw rotor is maintained in the lowest speed range until no pressure differences acting in an accelerating manner on the at least one screw rotor are present.

18. The method in accordance with claim 13, further comprising using the operation control unit, during at least one of: i) the operation termination mode; and ii) the holding mode; to activate a pressure relief between the low-pressure side and the high-pressure side of the compressor/expander machine.

19. The method in accordance with claim 1, further comprising operating the compressor/expander machine as a compressor machine, in which an operation control unit is configured as a compressor operation control unit and comprises an inverter device which has a rectifier which feeds a DC link from an AC supply grid, and wherein the inverter device has a converter which feeds the motor unit of the compressor machine from the DC link.

20. The method in accordance with claim 1, further comprising operating the compressor/expander machine as an expander machine, in which an operation control unit is configured as an expander operation control unit and has an inverter device, which has a grid converter which, is connected to an AC supply grid and feeds energy from the supply grid into a DC link or feeds energy from the DC link into the supply grid, wherein the expander operation control unit has a compressor converter which feeds a motor for a compressor for a circuit operated in a thermodynamic cycle from the DC link, and wherein the expander operation control unit has a generator converter which feeds energy supplied by the generator unit into the DC link.

21. A method for operating a refrigerant circuit, having a cooling device or a heat pump or a vapor compression system, with a first heat exchanger in which expanded refrigerant absorbs heat, and with a compressor/expander machine for compressing the expanded refrigerant, a second heat exchanger in which compressed refrigerant emits heat, and including an expansion unit for expanding the compressed refrigerant, wherein the compressor/expander machine has a machine housing with a screw rotor housing, in which at least one screw rotor is arranged between a low-pressure side and a high-pressure side for compressing/expanding the working medium, the screw rotor being coupled to a motor/generator unit, the method comprising:

for operating the compressor/expander machine, providing an operation control unit which, in the event of termination of operation of the compressor/expander machine, controls the speed of the motor/generator unit in accordance with a predetermined speed curve until a lowest speed range of the at least one of screw rotor is reached, which prevents damage in the region of the at least one screw rotor.

22. A method for operating a thermodynamic cycle, wherein an ORC system or a vapor expansion system, comprising a compressor for compressing a working medium, a first heat exchanger for heating the working medium, a compressor/expander machine for expanding the compressed and heated working medium and a second heat exchanger for cooling the expanded working medium, wherein the compressor/expander machine has a machine housing with a screw rotor housing, in which at least one screw rotor arranged between a low-pressure side and a high-pressure side is arranged for compressing/expanding the working medium and is coupled to a motor/generator unit, the method comprising:

Providing an operation control unit which, in the event of termination of operation of the compressor/expander machine, controls the speed of the motor/generator unit in accordance with a predetermined speed curve until a lowest speed range of the at least one of screw rotor is reached, which prevents damage in the region of the at least one screw rotor.

* * * * *